US011779182B1

(12) United States Patent
Harmelink et al.

(10) Patent No.: US 11,779,182 B1
(45) Date of Patent: Oct. 10, 2023

(54) SURFACE CLEANING APPARATUS

(71) Applicant: BISSELL Inc., Grand Rapids, MI (US)

(72) Inventors: Chris J. Harmelink, Wyoming, MI (US); Timothy R. Lambrix, West Olive, MI (US); Matthew R. Smith, Grand Rapids, MI (US); Matthew Gordon Kamps, Caledonia, MI (US); Eric Daniel Buehler, Grand Rapids, MI (US); Jacob S. Boles, Kentwood, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 18/080,835

(22) Filed: Dec. 14, 2022

(51) Int. Cl.
*A47L 11/30* (2006.01)
*A47L 11/40* (2006.01)

(52) U.S. Cl.
CPC ..... *A47L 11/30* (2013.01); *A47L 11/4005* (2013.01); *A47L 11/4022* (2013.01); *A47L 11/4027* (2013.01); *A47L 11/4041* (2013.01); *A47L 11/4083* (2013.01); *A47L 11/4088* (2013.01)

(58) Field of Classification Search
CPC .. A47L 11/30; A47L 11/4005; A47L 11/4022; A47L 11/4027; A47L 11/4041; A47L 11/4083; A47L 11/4088
See application file for complete search history.

(56) References Cited

U.S. PATENT DOCUMENTS

| | | | | |
|---|---|---|---|---|
| 7,685,671 | B2 | 3/2010 | Jansen | |
| 9,993,129 | B2 | 6/2018 | Santini | |
| 10,820,762 | B2 | 11/2020 | Paulla et al. | |
| 2019/0159646 | A1 | 5/2019 | Luyckx et al. | |
| 2020/0060496 | A1* | 2/2020 | Dawson | A47L 11/4041 |
| 2021/0093143 | A1* | 4/2021 | Nguyen | A47L 11/4016 |
| 2021/0267428 | A1 | 9/2021 | Scholten et al. | |

FOREIGN PATENT DOCUMENTS

| | | | |
|---|---|---|---|
| EP | 2890285 | B1 | 10/2016 |

* cited by examiner

*Primary Examiner* — David Redding
(74) *Attorney, Agent, or Firm* — WARNER NORCROSS + JUDD LLP

(57) ABSTRACT

A surface cleaning apparatus includes a fluid delivery system and a recovery system, and is operable in a plurality of user-selectable cleaning modes, including at least a wet vacuuming mode and a dry vacuuming mode. The fluid delivery system has a fluid dispenser that may comprise a spray manifold for wetting a brushroll. The recovery system includes a tank that may have a baffle to separate liquid and/or debris from a working airstream. Operating parameters of the apparatus may be automatically adjusted based on a detected floor type. The apparatus can dock with a tray for recharging and/or self-cleaning.

20 Claims, 21 Drawing Sheets

SURFACE CLEANING APPARATUS

BACKGROUND

Surface cleaning apparatus include wet/dry vacuum cleaners or multi-surface cleaners that can be used to clean hard floor surfaces such as tile and hardwood and soft floor surfaces such as area rugs and carpet. Some multi-surface cleaners comprise a fluid delivery system that delivers cleaning fluid, usually liquid, to a surface to be cleaned and a recovery system that extracts liquid and debris from the surface. The delivery system typically includes one or more supply tanks for storing a supply of cleaning liquid, a distributor for applying the liquid to the surface to be cleaned, and a supply conduit for delivering the liquid from the supply tank to the distributor. An agitator can be provided for agitating the liquid on the surface. The recovery system typically includes a recovery tank, a nozzle adjacent the surface to be cleaned and in fluid communication with the recovery tank, and a source of suction to draw liquid from the surface to be cleaned and through the nozzle and to the recovery tank.

Some multi-surface cleaners perform wet cleaning well, but at the expense of, or to the complete exclusion of, dry vacuuming. Providing a single cleaning apparatus that can effectively perform both wet cleaning of hard and soft floors, as well as dry vacuuming provides unique challenges related to fluid dispensing, surface agitation, and separation of collected liquid and debris.

The collection of both liquid and debris demands regular maintenance for multi-surface cleaners. Currently, the cleanout experience is often messy and time-consuming. As a result, users are disinclined to properly clean the multi-surface cleaner after operation, which can be unsanitary and lead to poor cleaning performance on subsequent uses of the multi-surface cleaner. Compliance with proper maintenance requirements has proved challenging to current multi-surface wet/dry vacuum cleaner designs.

BRIEF SUMMARY

An improved surface cleaning apparatus is provided herein. In certain aspects, the surface cleaning apparatus is a multi-surface wet/dry vacuum cleaner that can be used to clean hard floor surfaces such as tile and hardwood and soft floor surfaces such as area rugs and carpet.

According to one aspect of the disclosure, a surface cleaning apparatus is provided with an improved recovery system for removing fluid and debris from a surface to be cleaned and storing the fluid and debris onboard the apparatus. The recovery system includes a recovery having a path inlet and a path outlet, a suction source including a vacuum motor in fluid communication with the path inlet, and a recovery tank having a standpipe and a baffle that directs fluid and/or debris out of the working airstream to the sides and/or bottom of the recovery tank.

According to another aspect of the disclosure, a surface cleaning apparatus is provided with an improved delivery system for delivering cleaning fluid to a surface to be cleaned. The delivery system includes a supply tank configured to hold a cleaning fluid, a fluid dispenser, and a fluid supply path from the supply tank to the fluid dispenser, where the fluid dispenser comprises a spray manifold having an inlet and a supply chamber supplying cleaning fluid to a plurality of outlets, wherein the cross-section of the supply chamber decreases in a direction away from the inlet.

According to yet another aspect of the disclosure, a surface cleaning apparatus is operable in dry vacuuming mode and a smart wet cleaning mode in which at least one operating parameter is set based on floor type. Optionally, the apparatus has a turbo or intense cleaning mode for both dry and wet cleaning, in which at least one operating parameter, such as a suction power level, a fluid dispensing flow rate, and/or a brushroll speed are increased.

According to a still another aspect of the disclosure, a surface cleaning apparatus is provided with a floor type sensing mechanism. By detecting whether the floor surface under the apparatus is a hard floor or a soft floor, one or more operating parameters of the apparatus can be adjusted. In certain embodiments, a fluid dispensing flow rate, a brushroll speed, a suction power level, or any combination thereof can be set based on the detected floor surface.

According to a further aspect of the disclosure, a method for operating a surface cleaning apparatus includes sensing a floor type of the surface to be cleaned by generating sensor data during a cycle of operation of the surface cleaning apparatus with a sensor on-board the surface cleaning apparatus, processing the sensor data to determining whether the floor type is hard or soft flooring, and selecting a cleaning mode based on the sensed floor type. Optionally, a cleaning fluid flow rate, a brushroll speed, a suction power, or any combination thereof, is adjusted based on the sensed floor type.

In these and other aspects, the surface cleaning apparatus includes an upright handle assembly or body and a cleaning head or base coupled with the body and adapted for movement across a surface to be cleaned.

In these and other aspects, the surface cleaning apparatus has a moveable joint assembly that connects the base to the upright body for movement of the body about at least one axis. The joint assembly can be disposed behind a suction conduit of the apparatus.

In these and other embodiments, the surface cleaning apparatus has a rechargeable battery for cordless operation. The battery may be disposed above the supply tank, above the recovery tank, disposed rearwardly of the recovery tank, rearwardly of a handle axis of the handle, on a rear side of the frame, or any combination thereof.

In these and other aspects, a docking station or tray may be provided for docking the surface cleaning apparatus, for recharging the battery of the apparatus, and/or self-cleaning of the apparatus while the apparatus is docked In these and other aspects, the surface cleaning apparatus is provided with a self-cleaning mode in which an automatic, unattended cleanout cycle is executed.

These and other features and advantages of the present disclosure will become apparent from the following description of particular embodiments, when viewed in accordance with the accompanying drawings and appended claims.

Before the aspects of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DESCRIPTION OF EMBODIMENTS OF THE INVENTION

The invention generally relates to a surface cleaning apparatus, which may be in the form of a wet/dry vacuum cleaner or wet/dry multi-surface cleaner that can be used to clean hard floor surfaces such as tile and hardwood and soft floor surfaces such as area rugs and carpet. Aspects of the disclosure relate to an improved wet/dry multi-surface cleaner with multiple, user-selectable cleaning modes, including at least a wet vacuuming mode and a dry vacuuming mode. Aspects of the disclosure relate to a wet/dry multi-surface cleaner with improved fluid dispensing. Aspects of the disclosure relate to a wet/dry multi-surface cleaner with improved dry vacuuming features. Aspects of the disclosure relate to a wet/dry multi-surface cleaner with automatic floor type sensing. Aspects of the disclosure relate to a wet/dry multi-surface cleaner with improved architecture.

At least some embodiments of the surface cleaning apparatus provided herein function through the various elements thereof, as described below, to provide efficient separation of liquid and solid debris. By gently directing liquid and debris into a recovery tank and reducing air flow speed, the separation of liquid, debris, and air is encouraged. At least some embodiments of the surface cleaning apparatus provided herein function through the various elements thereof, as described below, to make the clean-out process easier, by providing an easy to clean tank with fewer and/or more accessible parts. At least some embodiments of the surface cleaning apparatus provided herein function through the various elements thereof, as described below, to provide improved fluid delivery to a brushroll. As such, certain features of the surface cleaning apparatus may be considered functional, but may also be implemented in different aesthetic configurations.

As used herein, the term "debris" includes dirt, soil, dust, hair, stains, and other debris, unless otherwise noted.

The functional systems of the surface cleaning apparatus can be arranged into any desired configuration, such as an upright device having a base and an upright body for directing the base across the surface to be cleaned, a portable device adapted to be hand carried by a user, a canister device having a cleaning implement connected to a wheeled base by a vacuum hose, an autonomous or robotic device having an autonomous drive system and an autonomously moveable housing, or a commercial device. Any of the aforementioned cleaners can be adapted to include a flexible vacuum hose, which can form a portion of a conduit between a nozzle and a suction source. As used herein, the terms "wet/dry vacuum cleaner" or "wet/dry multi-surface cleaner" includes a vacuum cleaner that can be used to clean hard floor surfaces such as tile and hardwood and soft floor surfaces such as carpet.

Figure 1:
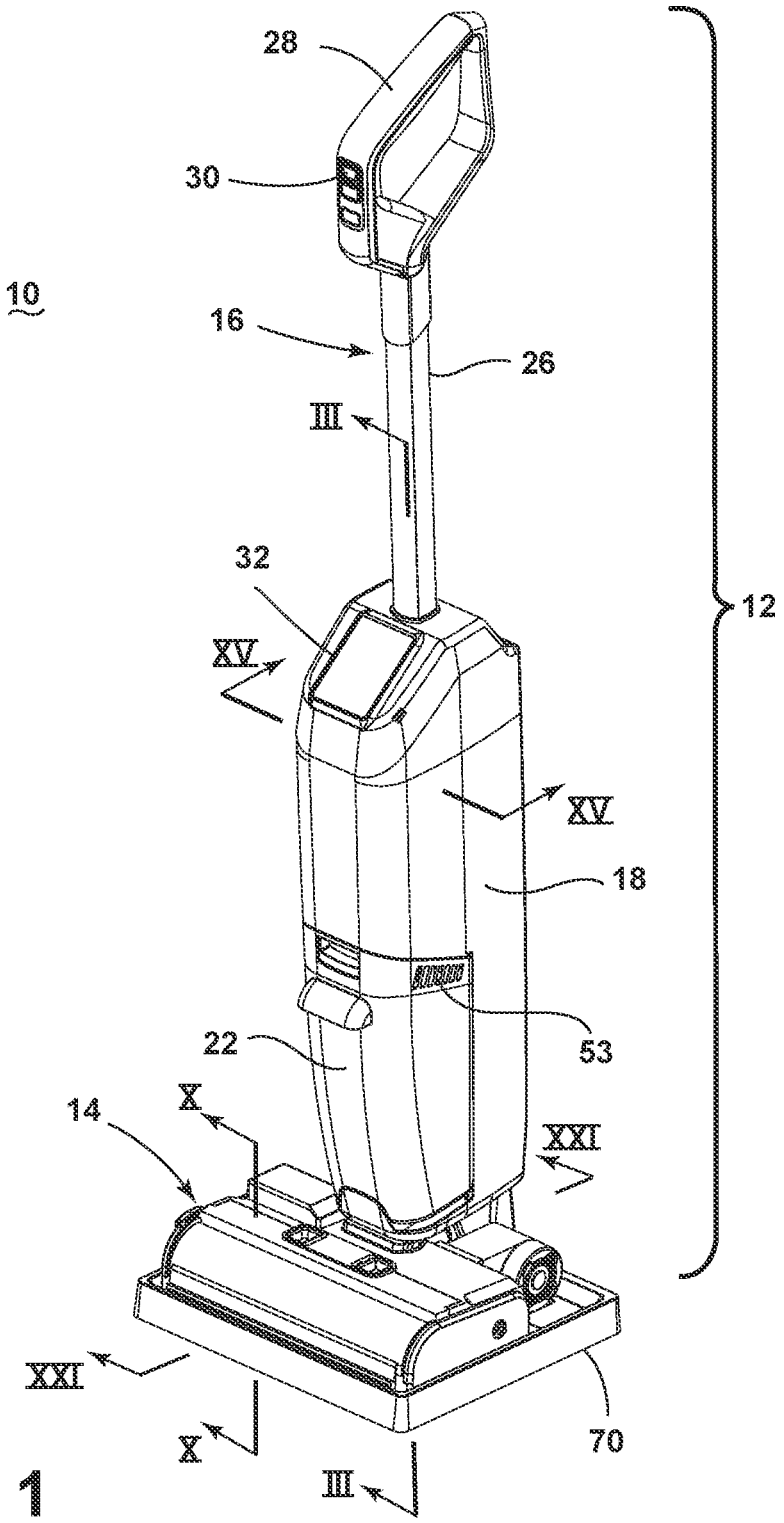
FIG. 1 is a perspective view of a surface cleaning apparatus according to one embodiment of the disclosure, showing the apparatus in an upright or storage position and docked on a tray.
Figure 2:
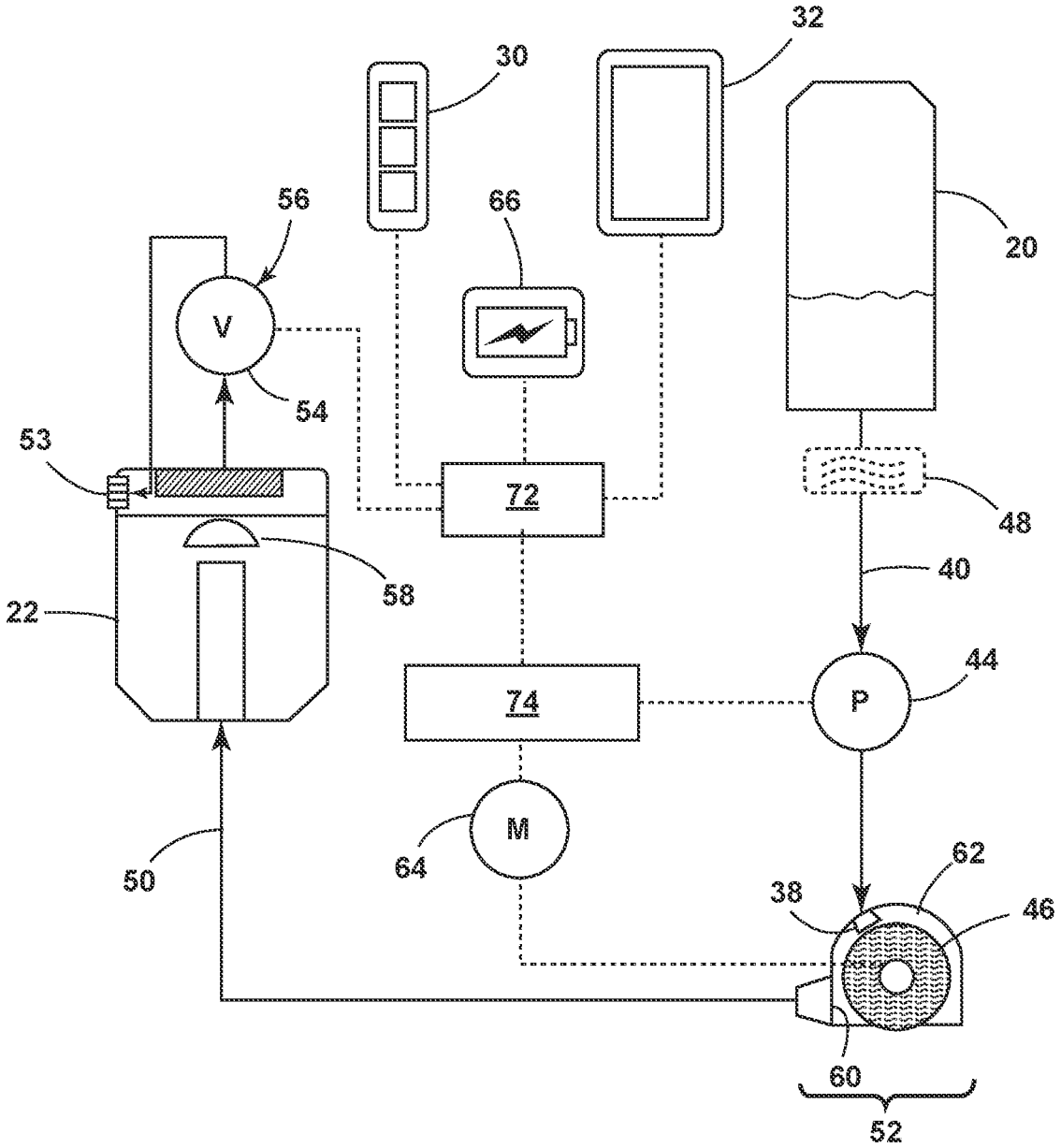
FIG. 2 is a schematic view of various functional systems of the apparatus.

FIGS. 1-2 show a surface cleaning apparatus 10 according to one aspect of the present disclosure. As discussed in further detail below, the apparatus 10 is provided with various features and improvements, which are described in further detail below.

The apparatus 10 can include multiple cleaning systems, including a fluid delivery system and a recovery system. With both fluid delivery and recovery systems, the apparatus 10 can deliver cleaning fluid to the surface to be cleaned and can recover fluid and debris from the surface to be cleaned.

As illustrated herein, the apparatus 10 can be an upright multi-surface wet/dry vacuum cleaner having a housing that includes an upright handle assembly or body 12 and a cleaning foot or base 14 mounted to or coupled with the upright body 12 and adapted for movement across a surface to be cleaned. The various cleaning systems and components thereof can be supported by either or both the base 14 and the upright body 12.

For purposes of description related to the figures, the terms "upper," "lower," "right," "left," "rear," "front," "vertical," "horizontal," "inner," "outer," and derivatives thereof shall relate to the disclosure as oriented in FIG. 1 from the perspective of a user behind the apparatus 10, which defines the rear of the apparatus 10. However, it is to be understood that the disclosure may assume various alternative orientations, except where expressly specified to the contrary.

The upright body 12 can comprise a handle 16 and a frame 18. The frame 18 can comprise a main support section at least partially supporting a supply tank 20 and a recovery tank 22, and may further support additional components of the body 12, including, but not limited to, a battery 66. The apparatus 10 can include a fluid delivery or supply pathway, including and at least partially defined by the supply tank 20, for storing cleaning fluid, e.g. cleaning liquid, and delivering the cleaning fluid to the surface to be cleaned and a recovery pathway, including and at least partially defined by the recovery tank 22, for removing liquid and debris from the surface to be cleaned and storing the liquid and debris until emptied by the user.

The handle 16 can include a handle tube 26 having a hand grip 28 at an upper end thereof. The handle tube 26 can extend upwardly from the frame 18, and may be elongated to define a longitudinal handle axis 24. Various configurations for the hand grip 28 are possible, including a loop-shaped grip as shown, or a non-looped, stick-like grip.

The apparatus 10 can include at least one user interface ("UI") through which a user can interact with the apparatus 10 to accomplish one or more functions. The UI can, among other abilities, accept user inputs for controlling the cleaning system and/or function as a communication output device for the cleaning system. To accept user inputs, the UI can have at least one user input control operably connected to one or more components or systems of the apparatus 10 to affect and control its operation. Non-limiting examples of input controls include buttons, triggers, toggles, keys, switches, or the like, or any combination thereof. To communicate output to the user, the UI can have at least one status indicator, or a status display including a plurality of status indicators, that communicates a condition or status of the apparatus 10, including systems and components thereof, to the user. Non-limiting examples of status indicators include visual indicators such as lights (e.g., LEDs), icon displays, textual displays, graphical displays, or the like, or any combination thereof. The UI can also include an auditory output component, such as a speaker.

In some embodiments, the apparatus 10 may include a first UI 30 and a second UI 32. The first UI 30 can be an input UI configured to accept user inputs to control the apparatus 10, including systems or components thereof and the second UI 32 can be an output UI configured to indicate status information relating to the apparatus 10, including systems or components thereof.

While the first UI 30 is referred to herein as an input UI, in some embodiments the first UI 30 may have an output functionality as well. For example, the first UI 30 may, in some embodiments, include at least one status indicator that communicates a condition or status of the apparatus 10, including systems and components thereof, to the user. In other embodiments, the first UI 30 solely accepts input, and does not provide outputs to the user.

While the second UI 32 is referred to herein as an output UI, in some embodiments the second UI 32 may have an input functionality as well. For example, the second UI 32 may, in some embodiments, include at least one user input control operably connected to one or more components or systems of the floor cleaner 10 to affect and control its operation. In other embodiments, the second UI 32 solely provides output, and does not accept inputs from the user.

The first and second UIs 30, 32 are separate from each other, and are located on different areas of the floor cleaner 10. The upright body 12, or more particularly the handle 16, or more particularly the hand grip 28, can include the first UI 30. The first UI 30 can conveniently be located adjacent to or on the grip 28, so that a user may hold the grip 28 in one hand and operate the first UI 30 with the same hand. For example, a user may wrap their palm and fingers around the grip 28, and operate the first UI 30 using the thumb of the same hand. Other locations for the first U 130 are possible. In other embodiments, the first U 130 may be distributed across multiple portions of the floor cleaner 10, such as including a first portion on the grip 28 and another portion on the handle 16 or frame 18, for example.

The upright body 12, or more particularly the frame 18, can include the second UI 32. The second UI 32 can conveniently be located on a front side of the frame 18, below the handle 16 and above the base 14, and optionally above the recovery tank 22. Other locations for the second UI 32 are possible, including on the base 14.

FIG. 2 is a schematic view of various functional systems of the apparatus 10. The delivery system includes the supply tank 20 configured to hold a cleaning fluid, at least one fluid dispenser 38 supplied with cleaning fluid from the supply tank 20, and a fluid supply path 40 from the supply tank 20 to the fluid dispenser 38.

The supply tank 20 can store cleaning fluid in liquid form. The cleaning fluid can comprise one or more of any suitable cleaning fluids, including, but not limited to, water, compositions, concentrated detergent, diluted detergent, other surface cleaning and/or treatment agents, and mixtures thereof. For example, the cleaning fluid can comprise water. In another example, the cleaning fluid can comprise a mixture of water and concentrated detergent.

It is noted that while the apparatus 10 described herein is configured to deliver a cleaning liquid, aspects of the disclosure may be applicable to surface cleaning apparatus that deliver steam. Thus, the term "cleaning fluid" may encompass liquid, steam, or both, unless otherwise noted.

The delivery system can include a flow controller for controlling the flow of fluid from the supply tank 20 to the fluid dispenser 38. In one configuration, the flow controller can comprise a pump 44, which pressurizes the supply path 40 and controls the delivery of cleaning fluid to the fluid dispenser 38. In one example, the pump 44 can be a centrifugal pump. In another example, the pump 44 can be a solenoid pump having a single, dual, or variable speed.

The release of cleaning fluid from the dispenser 38 can be controlled manually by the user, or automatically by selection of a cleaning mode. As described in further detail below, in some embodiments, operation of the pump 44 can be mode-dependent, such that the release of cleaning fluid from the dispenser 38 is controlled automatically. In other words, depending on a selected cleaning mode of the apparatus 10, the pump 44 may or may not be activated.

In another configuration of the supply pathway, the pump 44 can be eliminated and the flow control system can comprise a gravity-feed system having a valve fluidly coupled with an outlet of the supply tank 20, whereby when valve is open, cleaning fluid will flow under the force of gravity to the dispenser 38.

The dispenser 38 can comprise various structures, such as a nozzle, a spray tip, or a manifold, and can comprise at least one fluid outlet for dispensing cleaning fluid to the surface to be cleaned. The dispenser 38 can be positioned to deliver cleaning fluid directly to the surface to be cleaned, or indirectly by delivering cleaning fluid onto an agitator, such as, but not limited to, at least one brushroll 46. In one non-limiting example, the dispenser 38 delivers cleaning fluid onto a horizontally-rotatable brushroll 46.

The delivery system can include other conduits, ducts, tubing, hoses, connectors, valves, etc. fluidly coupling the components of the delivery system together and providing the supply path 40.

Optionally, a heater 48 can be provided for heating the cleaning fluid prior to delivering the cleaning fluid to the surface to be cleaned. In one example, an in-line heater 48 can be located downstream of the supply tank 20, and upstream or downstream of the pump 44. Other types of heaters can also be used. In yet another example, the cleaning fluid can be heated using exhaust air from a motor cooling air path for a suction source of the recovery system. In yet another example, the cleaning fluid is unheated.

In the embodiment shown in FIG. 2, the delivery system includes a single supply tank 20 for storing a supply of cleaning fluid. In another embodiment, the delivery system can have an additional supply container (not shown) for storing another cleaning fluid. For example, the supply tank 20 can store water and the second supply container can store a cleaning agent such as detergent. In embodiments where multiple supply containers are provided, the apparatus 10 can have a mixing system for controlling the composition of the cleaning fluid that is delivered to the surface.

The recovery system can include a recovery path 50 through the apparatus 10 having a path inlet 52 and a path outlet 53, a suction source 54 including a vacuum motor 56 in fluid communication with the path inlet and configured to generate a working stream through a recovery path 50, and the recovery tank 22 for separating and collecting liquid and debris from a working stream for later disposal. A separator 58 can be formed in a portion of the recovery tank 22 for separating liquid and entrained debris from the working stream. The separator 58 can, in some embodiments, comprise a baffle, aspects of which are described in further detail below. Other separators are possible.

In one embodiment, the path inlet 52 is disposed on the base 14 and can be defined by a suction inlet port 60 and/or a brush chamber 62 disposed on the cleaning head or base 14. One or both of the suction inlet port 60 and brush chamber 62 can be formed at least in part by a suction nozzle, a brush cover, or a combination thereof.

In one embodiment, the path outlet 53 is disposed on the recovery tank 22, and can be defined by an exhaust vent in the recovery tank 22. In another embodiment, the path outlet 53 is disposed elsewhere on the apparatus 10.

The apparatus 10 can include at least one agitator to agitate the surface to be cleaned. In one embodiment, the agitator is a rotating brushroll 46. In one non-limiting example, the suction inlet port 60 is positioned in close proximity to the brushroll 46 to collect liquid and debris directly from the brushroll 46. Other examples of agitators include, but are not limited to, dual horizontally-rotating brushrolls, one or more vertically-rotating brushes, a stationary brush, or a cleaning pad.

A drive assembly including a brushroll motor 64 can drive the brushroll 46. A drive transmission (not shown) operably connects the motor 64 with the brushroll 46 for transmitting rotational motion of the motor 64 to the brushroll 46. In other embodiment, a drive transmission can operably connect the brushroll 46 with the vacuum motor 56 to transmit rotational motion of the motor 56 to the brushroll 46.

Electrical components of the apparatus 10, including the pump 44, vacuum motor 56, brushroll motor 64, or any combination thereof, are electrically coupled to a power source, which can comprise a battery 66 for cordless operation, preferably a rechargeable battery. In one example, the rechargeable battery 66 is a lithium ion battery. The rechargeable battery can by recharged in place on the apparatus 10, or can be removed from the apparatus 10 for recharging. In another exemplary configuration, the battery 66 can comprise a user replaceable battery. In yet another embodiment, the power source can comprise power cord adapted to be plugged into a household electrical outlet for corded operation.

With a rechargeable battery, an appropriate charger can be provided with the apparatus 10. A charging port 68 (FIG. 3) can be provided on the upright body 12 and can be electrically coupled with the battery 66. In the illustrated embodiment, the charging port 68 is provided on a rear side of the frame 18. A tray 70 (FIG. 1) can store the apparatus 10 and recharge the battery 66 when not in use. The tray 70 can be configured to receive the base 14 of the floor cleaner 10 with the upright body 12 in a generally upright, stored position. The tray 70 can further be configured for further functionality, such as to self-clean the apparatus 10.

The apparatus 10 can include a main controller 72 operably coupled with the various systems and components of the apparatus 10. In one embodiment the main controller 72 can comprise a printed circuit board ("PCB"). As used herein, unless otherwise noted, the term "PCB" includes a printed circuit board having a plurality of electrical and electronic components that provide operational control to the apparatus 10. The PCB includes, for example, a processing unit (e.g., a microprocessor, a microcontroller, or another suitable programmable device) and a memory (e.g., a read-only memory ("ROM"), a random access memory ("RAM"), an electrically erasable programmable read-only memory ("EEPROM"), a flash memory, or another suitable magnetic, optical, physical, or electronic memory device). The processing unit is connected to the memory and executes instructions (e.g., software) that is capable of being stored in the RAM (e.g., during execution), the ROM (e.g., on a generally permanent basis), or another non-transitory computer readable medium such as another memory or a disc. Additionally or alternatively, the memory is included in the processing unit (e.g., as part of a microcontroller). Software stored in memory includes, for example, firmware, program data, one or more program modules, and other executable instructions. The processing unit is configured to retrieve from memory and execute, among other things, instructions related to the control processes and methods described herein. The PCB can also include, among other things, a plurality of additional passive and active components such as resistors, capacitors, inductors, integrated circuits, and amplifiers. These components are arranged and connected to provide a plurality of electrical functions to the PCB including, among other things, signal conditioning or voltage regulation. For descriptive purposes, a PCB and the electrical components populated on the PCB are collectively referred to as a controller. Thus, the main PCB and the electrical components populated on the main PCB may be referred to as main controller 72.

Optionally, a base controller 74, alternatively referred to herein as base PCB, can operably couple the main controller 72 with electrical components within the base 14 of the apparatus 10, such as the pump 44 and brush motor 64. In other embodiments, a separate base PCB is not included with the apparatus 10.

Figure 3:
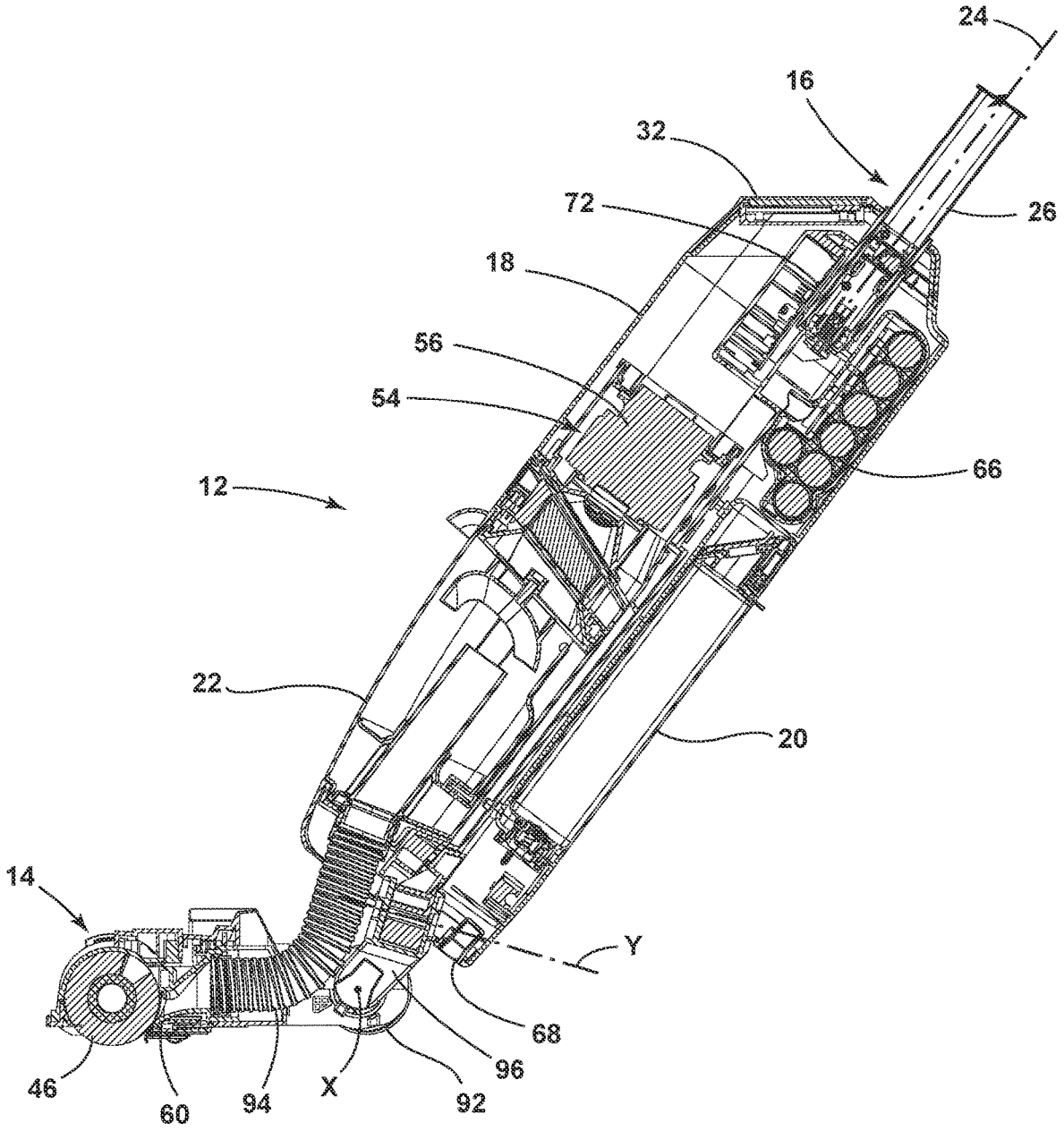
FIG. 3 is a cross-sectional view of the apparatus taken through line III-III of FIG. 1, showing the apparatus in a reclined or use position.

FIG. 3 shows an architectural layout for the upright body 12 according to one aspect of the disclosure, including locations and relative positions for components of the supply and recovery systems. Components including the supply tank 20, recovery tank 22, battery 66, vacuum motor 56, main controller 72, and display UI 32 are included on the upright body 12. The components of the upright body 12 are arranged with relative positioning that is well-balanced, comfortable for the user to operate, and provides protection for electronic components. For example, the tanks 20, 22 are disposed in a lower end of the frame 18 and the motor 56 and battery 66 are disposed in an upper end of the frame 18 to arrange these components in a generally linear, stacked orientation to provide a compact spatial arrangement for the upright body 12 that is comfortable to hold in a reclined use position. The recovery tank 22 is disposed on a lower forward side of the frame 18 and the supply tank 20 is disposed on a rearward side of the frame 18. The vacuum motor 56 is disposed above the recovery tank 22, generally on the forward side of the frame 18. The battery 66 is disposed above the supply tank 20, generally on the rearward side on the frame 18. With the battery 66 disposed above the tanks 20, 22, the battery 66 is isolated from potential exposure to liquids, such as from leaks from the tanks 20, 22 or other components of the fluid delivery and recovery systems. In the illustrated embodiment, the battery 66 is provided within the frame 18 of the upright body 12, on a rear side thereof. The supply tank 20, and one or more conduits coupling the tank 20 to components of the delivery system in the base 14, can be disposed below the battery 66. Other electronic components, such as the main controller 72 and UI 32 may be disposed above the tanks 20, 22 for similar reasons, and may further use the available space above the vacuum motor 56 and in front of the battery 66. Other arrangements of the components of the apparatus 10 are possible, while maintaining a well-balanced and comfortably operable apparatus 10, and isolated electronic components.

Figure 4:
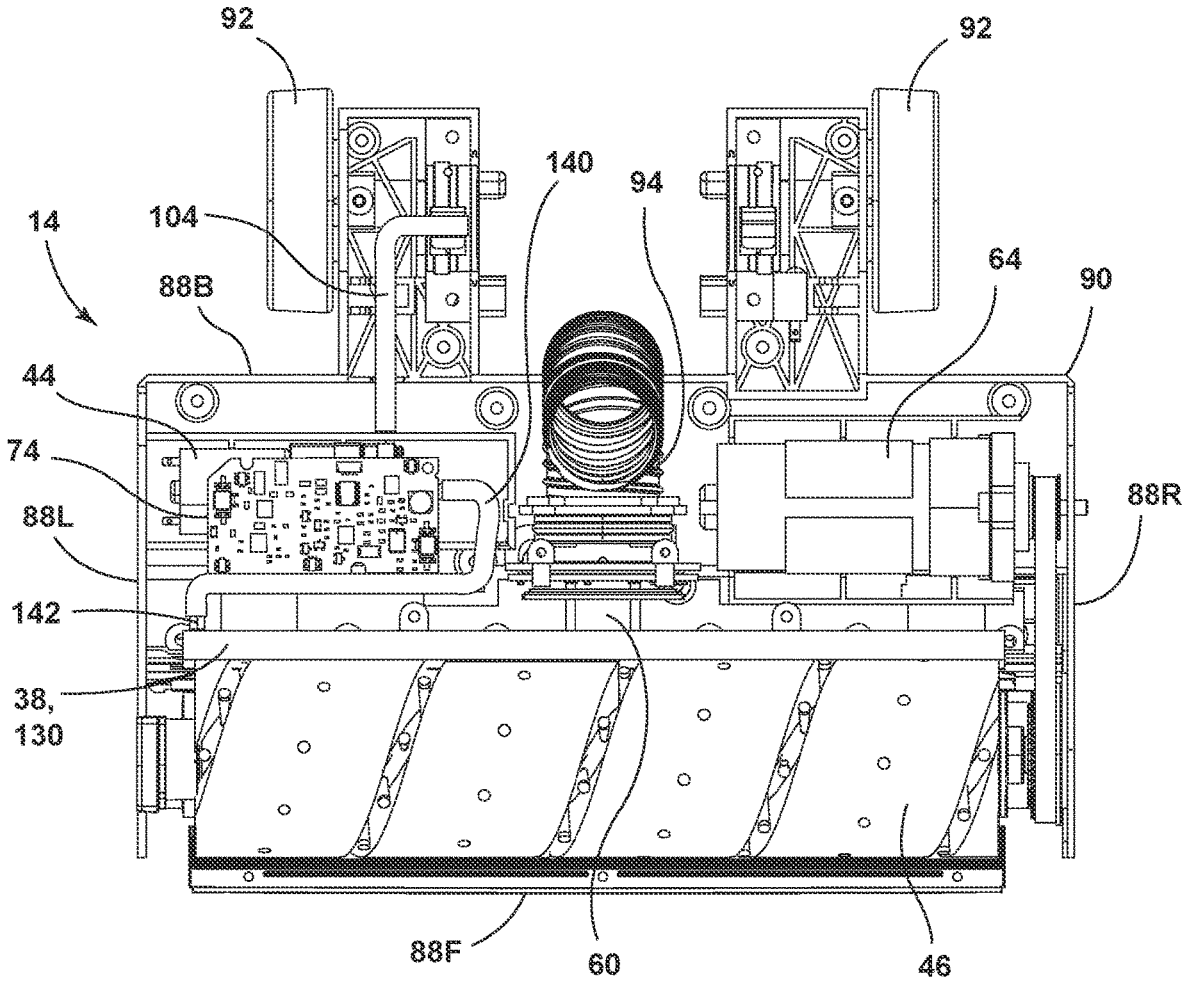
FIG. 4 is a top view of a base of the apparatus showing an architectural layout including locations and relative positions for components, with portions of the base removed for clarity.

FIG. 4 shows an architectural layout for the base 14 according to one aspect of the disclosure, including locations and relative positions for components of the supply and recovery systems. Components including the pump 44, brushroll 46, and brushroll motor 64 are included on the base 14. For clarity of the architectural layout, one or more housing pieces and component covers of the base 14 are not shown in FIG. 4.

In one embodiment, the base 14 includes a plurality of sides, including, for example, a front side 88F, a first lateral or right side 88R, a second lateral or left side 88L, and a rear side 88B. The base 14 can include a base housing 90 supporting the components of the base 14, the base housing 90 including one or more housing pieces and/or covers assembled together, and, in some embodiments, defining one or more of the sides of the base 14. Wheels 92 can at least partially support the base housing 90 for movement over the surface to be cleaned.

The components of the base 14 are arranged with relative positioning that provides an architecture that is low-profile and easily maneuvered along a surface to be cleaned. For example, the pump 44 and brushroll motor 64 are disposed rearwardly of the brushroll 46. As another example, the pump 44 and brushroll motor 64 are located on opposing sides of the suction inlet port 60, only a portion of which is visible in FIG. 4. A conduit 94 fluidly coupling the port 60 to the recovery tank 22 (FIG. 3), and forming a portion of the recovery path 50 (FIG. 2) can pass between the pump 44 and the brush motor 64, and can generally bisect a rear portion of the base 14 into a pump cavity in which the pump 44 is located and a brush motor cavity in which the brush motor 64 is located. The base PCB 74 can be located above the pump 44. Other arrangements of the components of the base 14 are possible.

Figure 5:
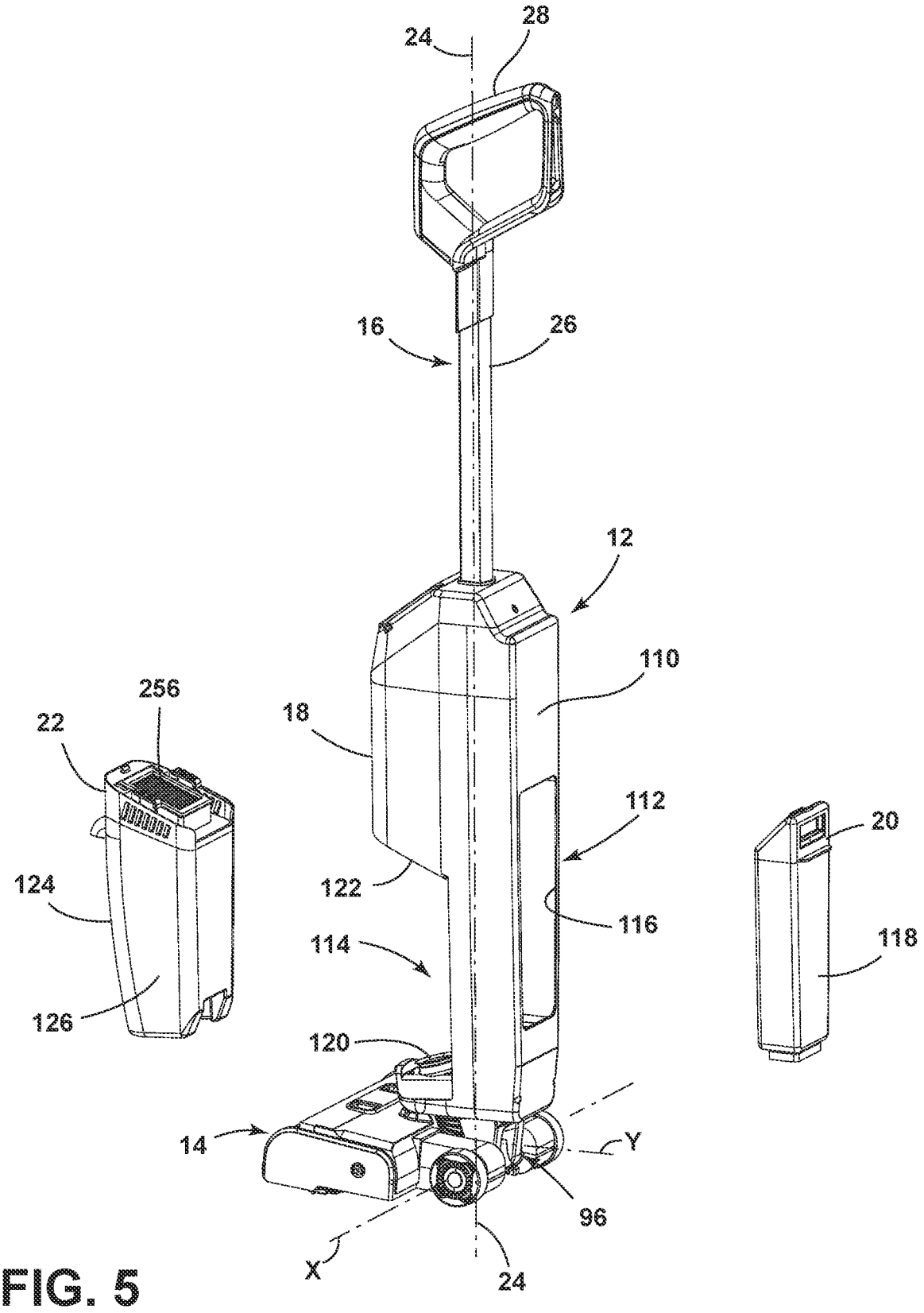
FIG. 5 is a rear perspective view showing supply and recovery tanks exploded from an upright body of the apparatus.

FIG. 5 is a rear perspective view showing the tanks 20, 22 exploded from the upright body 12. The tanks 20, 22 can be mounted to the frame 18 in any configuration. In the present embodiment, the tanks 20, 22 are removable from the frame 18 for filling/emptying. The supply tank 20 can be removably mounted at the rear of the frame 18 such that the supply tank 20 is through a rear side 110 of the frame 18 for filling.

The upright body 12 comprises tank sockets or receivers 112, 114 for respectively receiving the supply and recovery tanks 20, 22. As shown herein, in one embodiment the tank receivers 112, 114 can be defined by portions of the frame 18, and can be provided on opposing sides of the frame 18, and more particularly on rear and front sides of the frame 18, respectively.

The supply tank 20 can be removably mounted at the rear of the frame 18 such that the supply tank 20 is through the rear side 110 of the frame 18. The supply tank receiver 112 has an access opening 116 at the rear side 110, and the supply tank 20 is loaded and unloaded through the access opening 116. A wall 118 of the supply tank 20 is visible and forms a rear external surface of the apparatus 10 when the tank 20 is seated in the receiver 112. With this configuration, a user can easily load and upload the supply tank 20 from a typical operating position behind the apparatus 10.

The recovery tank receiver 114 can be disposed generally in front of the supply tank receiver 112 and can include a recovery tank support 120 on which the tank 22 rests and a ceiling 122 generally opposite the support 120. The recovery tank receiver 114 can have open front and lateral sides, such that front and lateral walls 124, 126 of the recovery tank 22 are visible and form external surfaces of the apparatus 10 when the tank 22 is seated in the receiver 114. With this configuration, a user can easily observe the contents of the tank 22 from various perspectives and with the upright body 12 in various reclined use positions.

The apparatus 10 can have a moveable joint assembly 96 that connects the base 14 to the upright body 12 for movement of the body 12 about at least one axis. In one embodiment, the joint assembly 96 can comprise a multi-axis joint that couples the base 14 to the upright body 12 for movement about at least two axes of rotation X, Y. The upright body 12 is pivotable relative to the base 14 about the first axis X between the upright storage position (FIG. 5) and a reclined use position (e.g. FIG. 3). The body 12 pivotable relative to the base 14 about the second axis Y to steer the base 14 as the base 14 moves over a surface. The body 12 can be pivoted about the axes X, Y by the user using the handle 16. In the reclined use position, the upright body 12 forms an acute angle with the surface to be cleaned and a user can partially support the apparatus 10 by holding the hand grip 28. The handle axis 24 can intersect the joint assembly 96.

Figure 6:
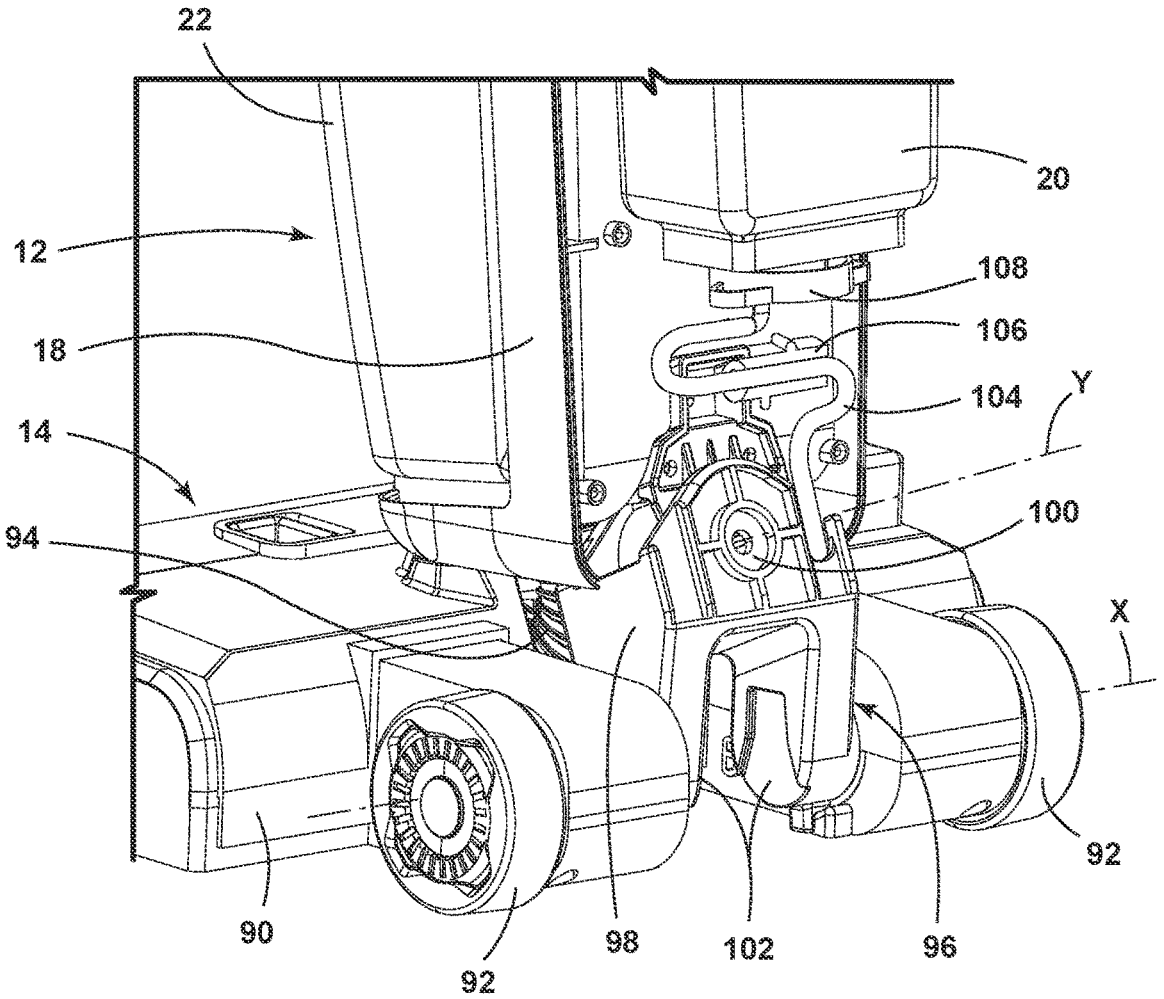
FIG. 6 is a rear perspective view showing a joint assembly of the apparatus, with a rear housing cover of the apparatus removed for clarity to show a fluid supply path through the joint.

Referring to FIG. 6, in one aspect of the disclosure the joint assembly 96 includes an upright connector 98 coupled with a lower end of the frame 18 by a swivel joint 100 to define axis Y and coupled with the base 14 by pivot joints 102 to define axis X. Other configurations for the multi-axis joint are possible. For clarity, a rear housing cover of the frame 18 is not shown in FIG. 6.

In the upright or storage position, the upright body 12 is oriented substantially upright relative to the surface to be cleaned and the apparatus 10 is self-supporting, i.e. the apparatus 10 can stand upright without being supported by something else. A joint lock (not shown) can selectively engage and lock the upright body 12 in the upright or storage position. When locked in the upright/storage position, the joint assembly 96 is locked-out and the upright body 12 is not moveable about either axis X, Y. When reclined, the joint assembly 96 is released and the upright body 12 can move relative to the base 14 about the axes X, Y.

The conduit 94, which is alternatively referred to herein as a suction conduit since it defines a portion of the recovery path 50 (FIG. 2) can pass outside the joint assembly 96. For example, as shown in FIG. 3, the conduit 94 is disposed outside and forwardly of the joint assembly 96. As such, the pivot axis X does not pass through the conduit 94. The conduit 94 may further be disposed forward of the handle axis 24 in the upright storage position. At least a portion of the conduit 94 can be flexible to accommodate the movement of the joint assembly 96, and can comprise a flexible tube or hose.

Wiring and/or conduits supplying electricity and/or cleaning fluid between the upright body 12 and the base 14 can extend though the joint assembly 96. As shown in FIG. 6 a supply conduit 104 can extend from the supply tank, through the joint assembly 96 and into the base 14 to couple with the pump 44 (FIG. 4).

A flow sensor 106 can be disposed in the supply path between the supply tank 20 and the pump 44 to detect the flow of fluid through the supply path. When the flow of fluid is not detected, e.g., when the tank 20 is empty or the supply path is blocked, a signal can be sent to the UI 32 (FIG. 1), which outputs a visual and/or audible user alert. In one non-limiting embodiment shown in FIG. 6, the sensor 106 is downstream of a valve receiver 108 for the tank 20 and can form a portion of the supply conduit 104. The supply tank 20 is removably mounted on the apparatus 10, and includes an outlet valve (not shown) that automatically closes when the tank 20 is removed from the apparatus 10 to prevent leaking. The valve receiver 108 is configured to open the outlet valve when the supply tank 20 is mounted on the apparatus.

Referring to FIGS. 4 and 7-10, the fluid dispenser 38 according to one aspect of the disclosure can be a spray manifold 130 having multiple outlets 132 configured to spray cleaning fluid onto the brushroll 46. The spray manifold 130 has an internal channel 134 shaped to uniformly distribute cleaning fluid to each outlet 132.

The spray outlets 132 are disposed on a front side 138 of the manifold 130. Cleaning fluid is supplied into the internal chamber 134 through an inlet port 142, which can be formed by an inlet connector of the spray manifold 130. By way of non-limiting example, the inlet port 142 can supply fluid through a rear side 144 of the spray manifold 130, with the spray outlets 132 on the front, e.g. forward-facing, side 138 of the spray manifold 130.

Referring to FIG. 4, the pump 44 can supply fluid through a pump conduit 140 to the inlet connector 142 of the spray manifold 130. The pump conduit 140 can comprise flexible hose or tubing, and are shown schematically in FIG. 4. In one embodiment, the manifold 130 is elongated laterally and has two opposing lateral ends, and the inlet connector 142 is disposed at one lateral end 146 thereof. The pump conduit 140 can therefore connect to the manifold 130 at one lateral end 146 thereof. The spray manifold 130 can be laterally elongated to provide spray coverage across the brushroll 46.

Figure 7:
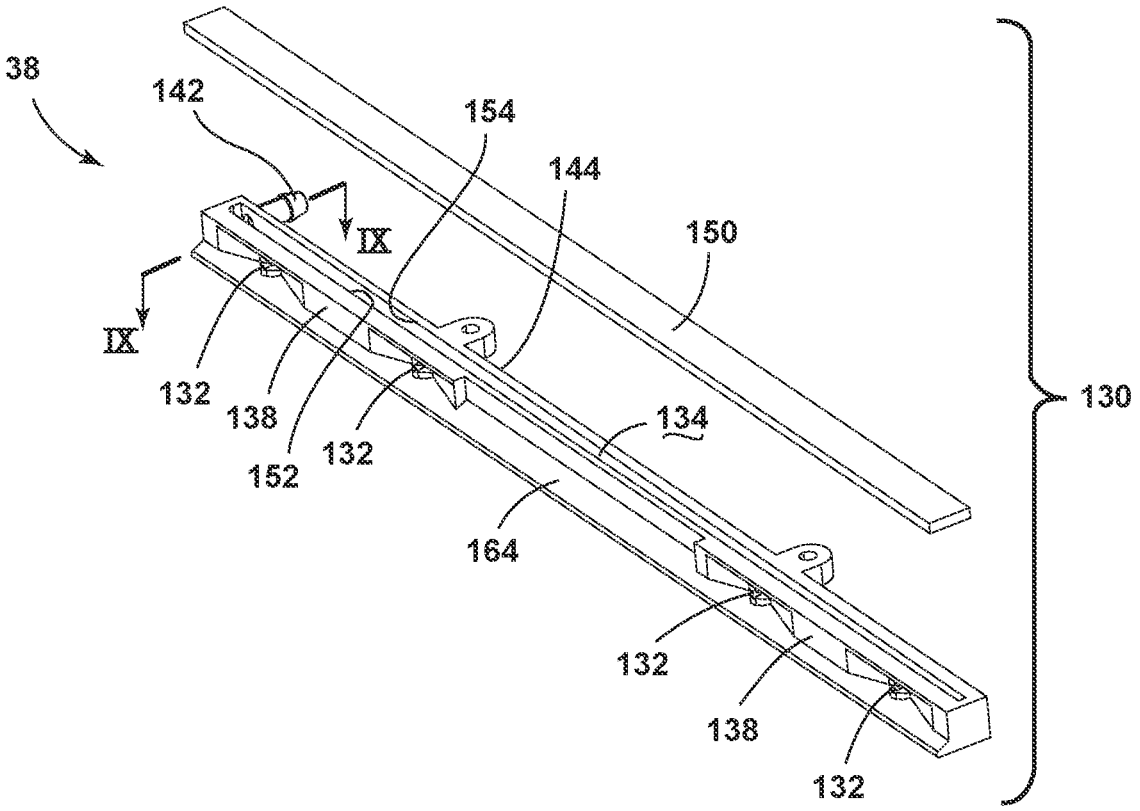
FIG. 7 is an exploded view of a fluid dispenser of the apparatus.
Figure 8:
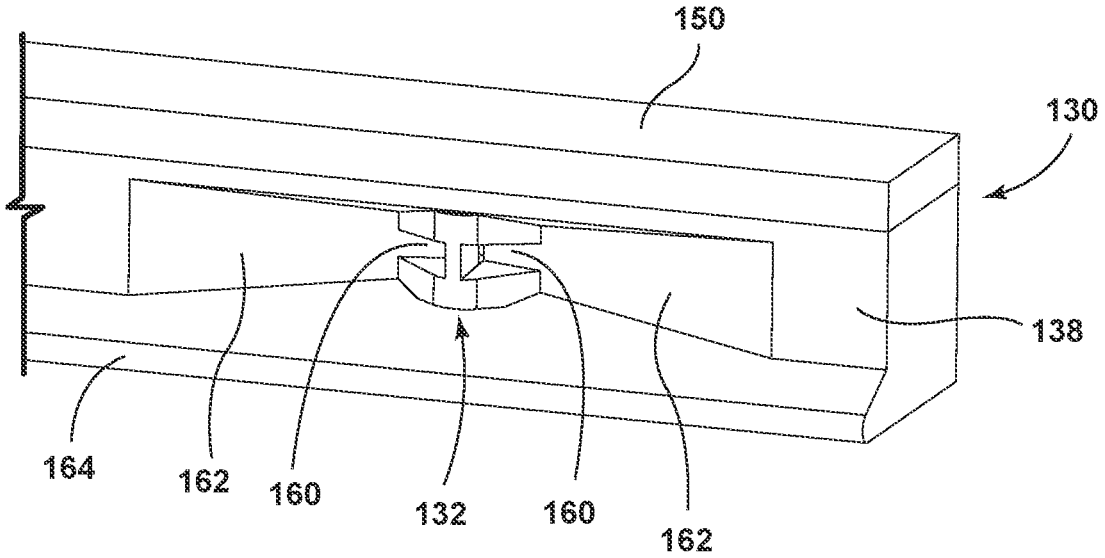
FIG. 8 is a close-up view showing an outlet of the fluid dispenser.
Figure 9:
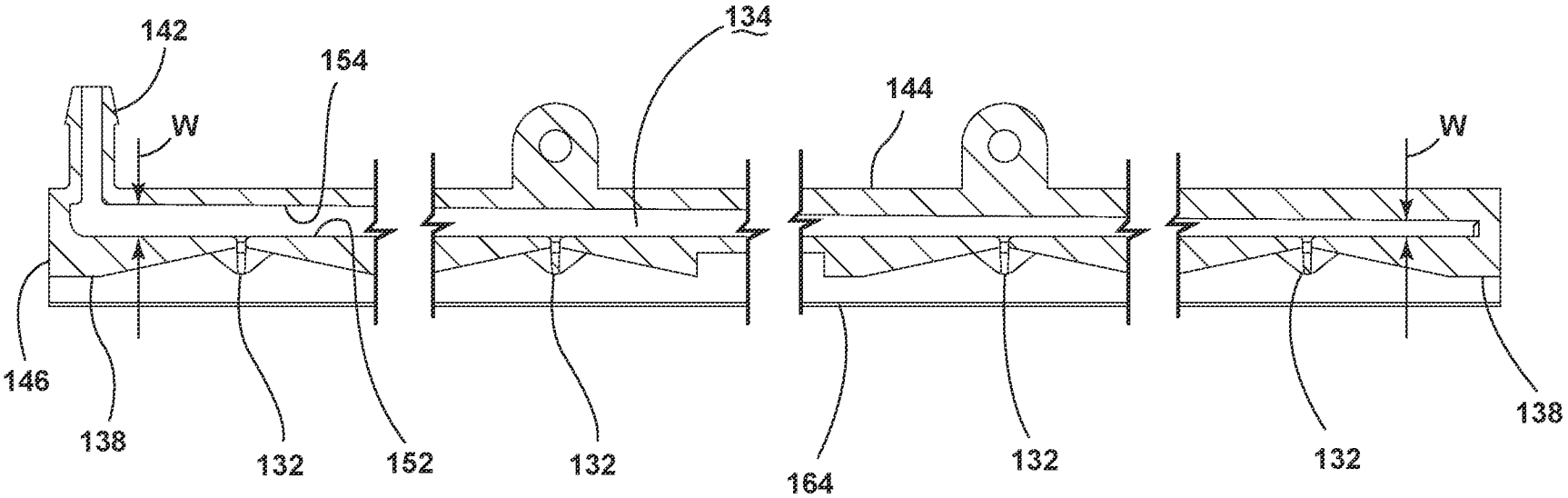
FIG. 9 is a cross-sectional view of the fluid dispenser taken through line IX-IX of FIG. 7, with break lines indicating that the full length of the fluid dispenser is not shown.

Referring to FIGS. 7-9, by way of non-limiting example, the spray manifold 130 can include four spray outlets 132. The outlets 132 can be laterally, and in some configurations equally, spaced from each other. With a plurality of laterally-spaced outlets 132 as shown, the spray manifold 130 can spray fluid across substantially the entire length of the brushroll 46. Other spray patterns are possible.

The internal channel 134 within the manifold 130 fluidly connects the inlet connector 142 with the spray outlets 132. The channel 134 can be laterally-elongated to encourage fluid to spread across the length thereof to distribute fluid evenly to each outlet 132. By way of non-limiting example, the channel 134 can be formed by a manifold body 148 having a cover 150, with the manifold body 148 including the front and rear sides 138, 144 of the spray manifold 130 and the cover 150 closing an open top of the body 148 to seal the channel 134. The cover 150 may be a separate piece due to manufacturing constraints, but could be integral with the body 148 in other embodiments. In yet other embodiments, another wall of the body 148 can be initially formed a separate piece.

The inlet connector 142 can be disposed closer to one end 146 of the manifold 130 than the other end. In other words, the inlet connector 142 may not be disposed at or near a center of the manifold 130, but rather is offset toward one end 146 thereof. By way of non-limiting example, the inlet connector 142 is disposed at one lateral end 146 of the manifold 130, to supply liquid to a corresponding end of the internal channel 134. As such, liquid may generally flow through the internal channel 134 in one direction to reach all outlets 132, rather than dividing and flowing in opposing directions.

The internal channel 134 of the manifold 130 can be configured to provide a substantially uniform flow rate from all outlets 132. This may be particularly beneficial in embodiments where the inlet 142 is at one end of the manifold 130. As the distance from the inlet 142 increases, flow rate decreases if the channel 134 remains uniform, e.g. has a constant cross-sectional area, and therefore less cleaning fluid would be dispensed by outlets farther to the inlet. To provide uniform, or substantially uniform fluid distribution, in one embodiment, the cross-sectional area of the channel 134 at an outlet 132 may be inversely proportional to the outlet's distance from the inlet. In other words, the cross-sectional area of the channel 134 is smaller for outlets 132 disposed farther from the inlet 142. By way of non-limiting example, the channel 134 is tapered to decrease the cross-sectional area of the channel 134, which compresses the flowing cleaning fluid and increases flow rate. While a continuously tapering channel 134 is shown, in other embodiments, the channel 134 can have more or more discretely tapered sections, or sections of decreased cross-sectional area to achieve uniform, or substantially uniform fluid distribution. As used herein, a uniform, or substantially uniform fluid distribution includes deviations of up to 15% in flow rate, alternatively up to 10% in flow rate.

By way of non-limiting example, the channel 134 is tapered in a transverse direction such that a width W of the channel 134 decreases in a direction away from the inlet 142. In the embodiment shown, the front side 138 is defined by a tapered front channel wall 152 that is disposed at an angle to a rear channel wall 154 defining the rear side 144, such that the front and rear channel walls 152, 154 are not parallel. The width W of the channel 134 is defined between an inner surface of the front wall 152 and an inner surface of the rear wall 154. In another embodiment, the rear wall 154 may taper. Referring to FIG. 9, the width W of the channel 134 at the outlet 132 closest to the inlet 142 is greater than the width W at the other outlets 132, with the width W at the outlet 132 farthest from the inlet 142 being the smallest.

Figure 10:
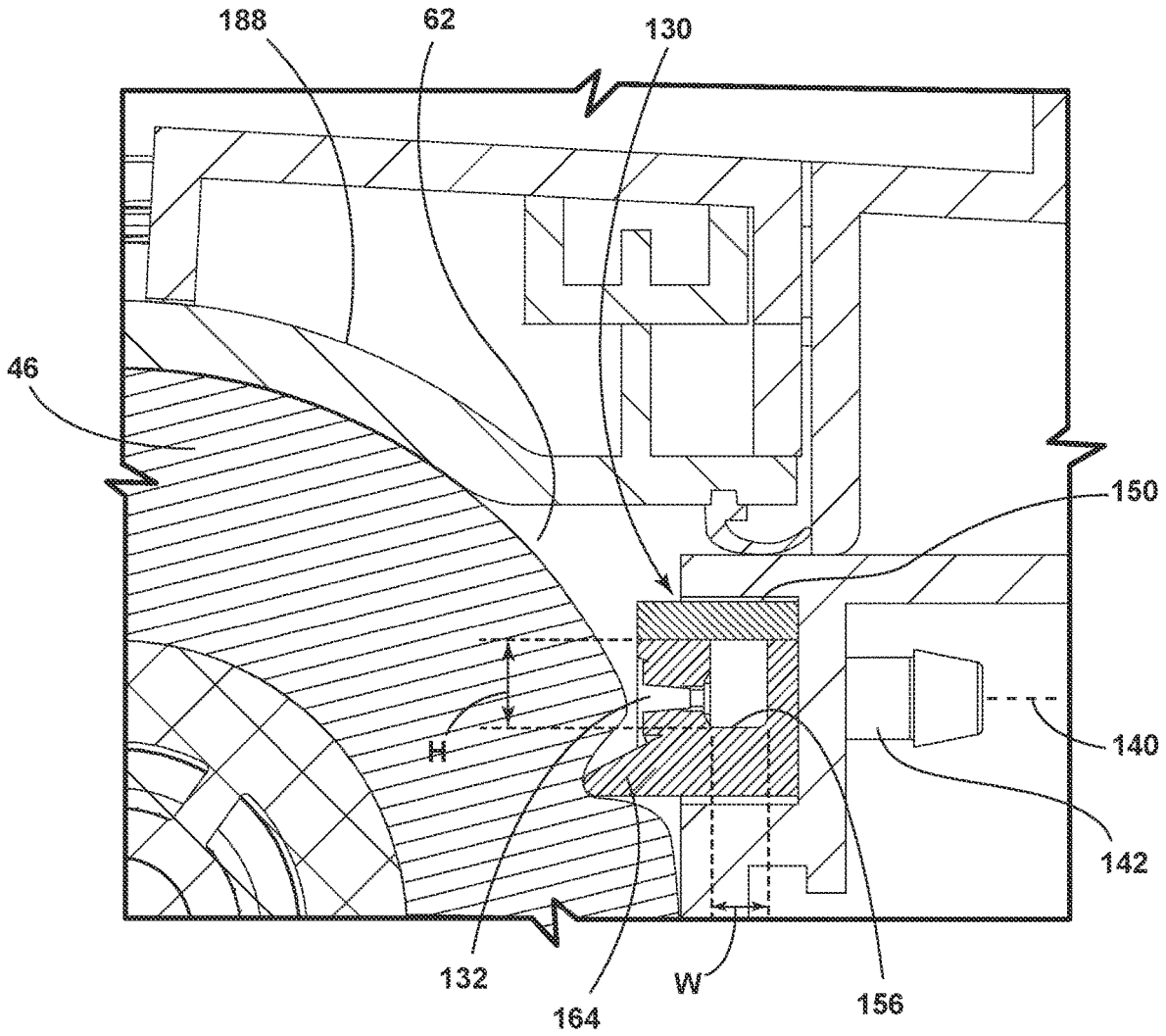
FIG. 10 is a close-up, cross-sectional view of the fluid dispenser adjacent a brushroll, taken through line X-X of FIG. 1.

Referring to FIG. 10, the channel 134 may be further defined by a top channel wall, e.g. the cover 150, and a bottom channel wall 156, with a height of the channel 134 defined between the top and bottom channels walls 150, 156. The manifold 130 may be configured to take up more vertical space than horizontal space, with the height H being greater than the maximum width W of the channel 134.

In the embodiment shown, the height H of the channel 134 remains constant as its width W decreases. In yet another example, the channel 134 can taper in a vertical direction, such that the height H decreases in a direction away from the inlet 142. In yet another example, the channel 134 can taper in multiple directions, such as, but not limited to, the transverse and vertical directions.

The spray outlets 132 can have various configurations. In one embodiment, each spray outlet 132 includes a plurality of discharge ports 160. Any suitable number, size, configuration, and angle of discharge ports 160 may be selected for facilitating distribution of fluid. For example, according to the illustrated embodiment, each outlet 132 includes two discharge ports 160 oriented at an angle relative to the front wall 138 in order to spread out the spray fluid. Optionally, the ports 160 may be recessed, and angled discharge walls 162 can extend from the discharge ports 160 to the front side 138 of the manifold to help direct flow from the ports 160 and/or can protect the ports 160 from debris. Alternatively, the ports 160 may be flush with the front of the manifold 130.

According to one exemplary embodiment, having an angle of about 90-120 degrees between the discharge ports 160, with the ports 160 directing a spray of fluid at an angle of about 10-45 degrees from parallel to the front wall 138, provides an even wetting across the brushroll 46. In addition, according to alternative embodiments, each discharge port 160 may have a different angle and/or different size than adjacent discharge ports 160. Other spray configurations are possible and within the scope of the present subject matter.

Figure 11:
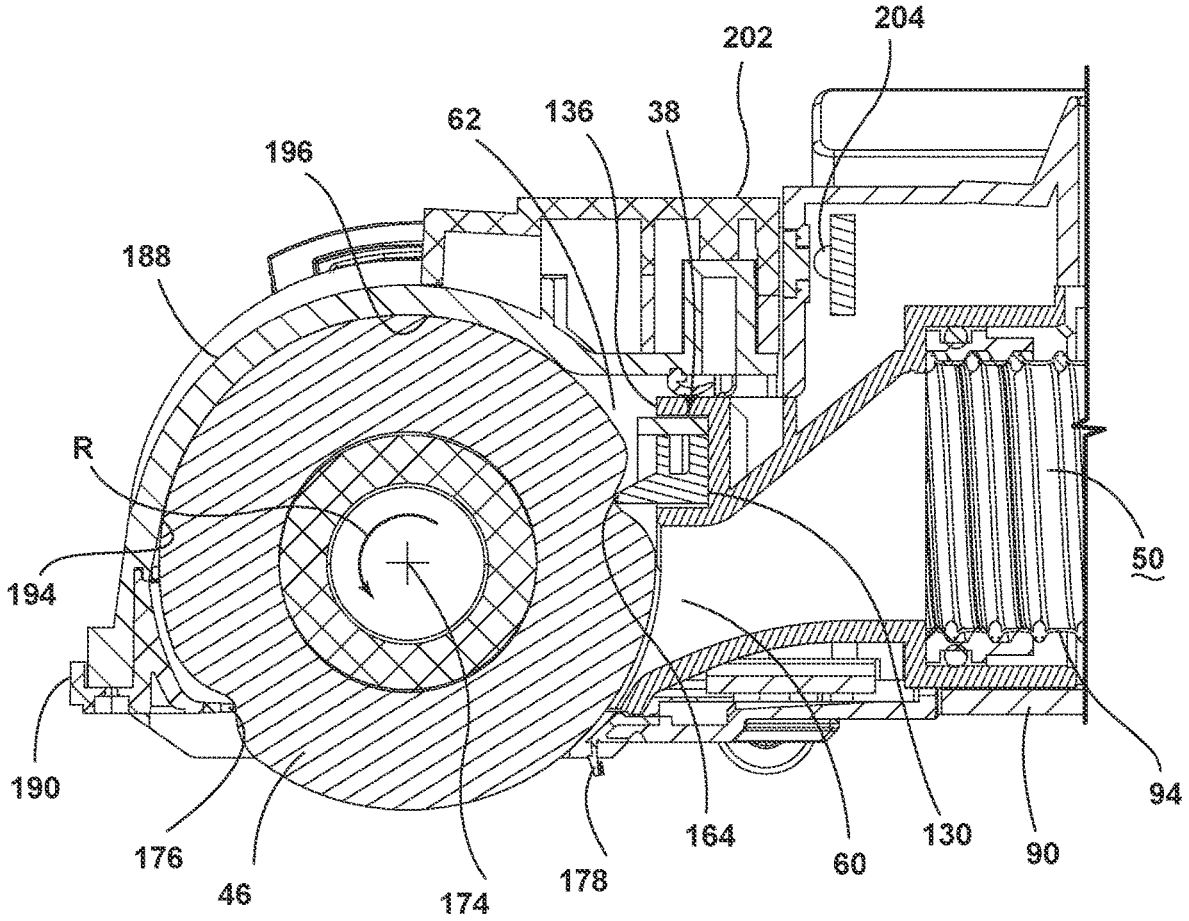
FIG. 11 is a close-up, cross-sectional view of the base, taken through line III-III of FIG. 1.

Referring to FIG. 11, the brushroll 46 can be received in the brush chamber 62 and disposed at least partially within or adjacent to the recovery path 50. In the present embodiment, the suction inlet port 60 is configured to extract liquid and debris from the brushroll 46. With the brush chamber 62 being open to the surface to be cleaned, some liquid and debris may be extracted from the surface to be cleaned as well. As such, the brush chamber 62 can form a portion of the recovery path 50, with the suction inlet port 60 being open to the chamber 62. The brushroll 46 is positioned for rotational movement in a direction R about rotational axis 174.

An interference wiper 176 is mounted at a forward portion of the brush chamber 62 and is configured to interface with a leading portion of the brushroll 46, as defined by the direction of rotation R of the brushroll 46. The interference wiper 176 is generally below the dispenser 38, such that the wetted portion brushroll 46 rotates past the interference wiper 176, which can scrape any excess liquid off the brushroll 46 and/or evenly spread or distribute cleaning fluid across the width of the brushroll prior to reaching the surface to be cleaned. Ensuring that cleaning fluid is evenly distributed across the width of the brushroll can improve cleaning performance and minimize dry time of the surface to be cleaned. Optionally, the interference wiper 176 can be disposed generally parallel to the surface to be cleaned. Other locations for the wiper 176 in relation to the brushroll 46, where the wiper 176 is configured to interface with a portion of the brushroll 46, are possible.

The wiper 176 can be rigid, i.e. stiff, and non-flexible, so the wiper 176 does not yield or flex by engagement with the brushroll 46. Optionally, the wiper 176 can be formed of rigid thermoplastic material, such as poly(methyl methacrylate) (PMMA), polycarbonate, or acrylonitrile butadiene styrene (ABS). In other embodiments, the wiper 176 can be flexible.

A squeegee 178 is mounted behind the brushroll 46 and the brush chamber 62 and is configured to contact the surface as the base 14 moves across the surface to be cleaned. The squeegee 178 wipes residual liquid from the surface to be cleaned so that it can be drawn into the recovery pathway via the suction inlet port 60, thereby leaving a moisture and streak-free finish on the surface to be cleaned. Optionally, the squeegee 178 can be disposed generally orthogonal to the surface to be cleaned, or vertically. The squeegee 178 can be smooth as shown, or optionally comprise nubs on the end thereof for lifting a lower portion the squeegee 178 slightly to allow working air to pass under the squeegee 178 on a backstroke.

The squeegee 178 can be pliant, i.e. flexible or resilient, in order to bend readily according to the contour of the surface to be cleaned yet remain undeformed by normal use of the apparatus 10. Optionally, the squeegee 178 can be formed of a resilient polymeric material, such as ethylene propylene diene monomer (EPDM) rubber, polyvinyl chloride (PVC), a rubber copolymer such as nitrile butadiene rubber, or any material known in the art of sufficient rigidity to remain substantially undeformed during normal use of the apparatus 10.

Figure 12:
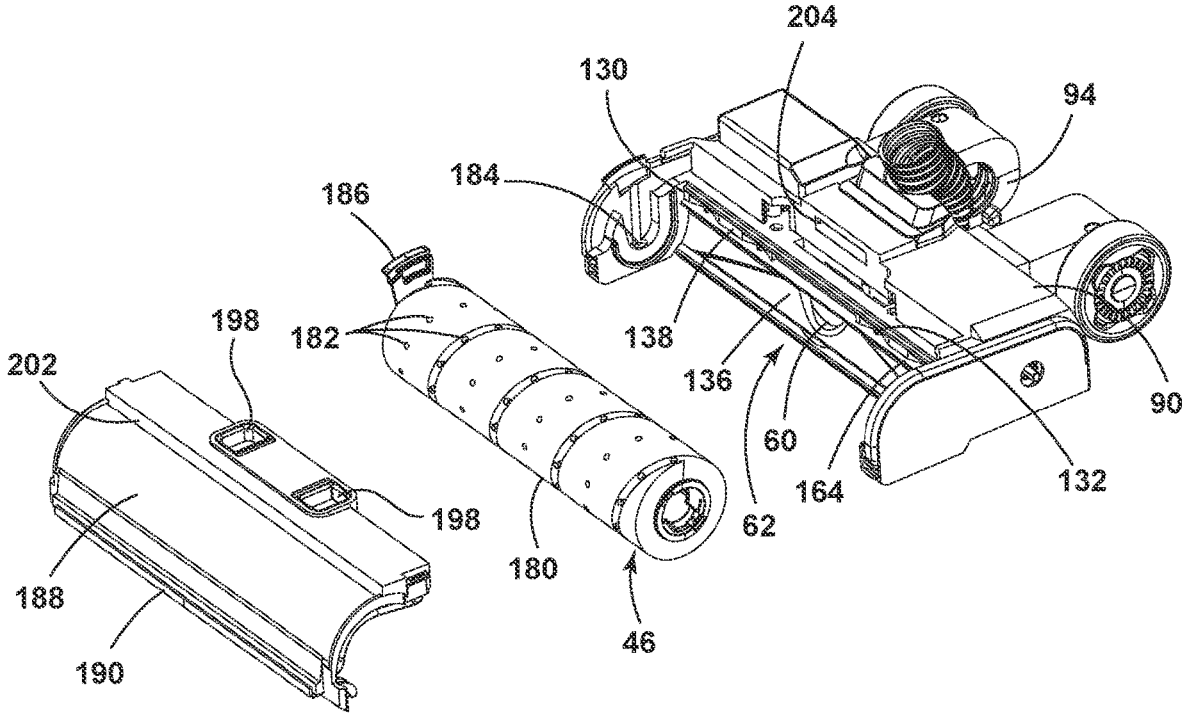
FIG. 12 is a partially exploded perspective view of the base.

FIG. 12 is an exploded view of the base 14. The brushroll 46 can be a hybrid brushroll suitable for use on both hard and soft surfaces, and for wet or dry vacuum cleaning. In one embodiment, the brushroll 46 comprises a combination of microfiber 180 and bristles 182 for agitation. The bristles 182 can be tufted or unitary bristle strips and constructed of nylon, or any other suitable synthetic or natural fiber. The microfiber 180 can be constructed of polyester, polyamides, or a conjugation of materials including polypropylene or any other suitable material known in the art from which to construct microfiber. Other embodiments of brushrolls are possible, such as a bristle brushroll suitable for use on soft surfaces, and having bristles 182 and no microfiber 180, and/or a microfiber brushroll suitable for use on hard surfaces and having microfiber 180 and no bristles 182. Optionally, the apparatus can be provided with multiple, interchangeable brushrolls, which allows for the selection of a brushroll depending on the cleaning task to be performed or depending on the floor type of be cleaned.

Referring to FIG. 11-12, the fluid dispenser 38, e.g. spray manifold 130, is disposed at a rear wall 136 of the brush chamber 62. Accordingly the spray manifold 130 is disposed generally rearwardly of the brushroll 46, and can direct a spray of cleaning fluid toward an upper rear portion of the brushroll 46. According to one exemplary embodiment, the front side 138 of the manifold 130 can define a portion of the rear wall 136 of the brush chamber 62, with the outlets 132 opening into the brush chamber 62. In alternative embodiments, the front side 138 can be recessed in the rear wall 136 or may project beyond the rear wall 136.

According to one aspect, a suction guard 164 is disposed between the suction inlet port 60 and the outlet of the fluid dispenser 38 to prevent cleaning fluid dispensed from the fluid dispenser 38 from getting suctioned into the recovery pathway 50 immediately and/or before to wetting the brushroll 46. Without the suction guard 164, cleaning fluid may be pulled directly into the recovery pathway 50, and may bypass the brushroll 46 entirely. The suction guard 164 partially projects into the nap of the microfiber brushroll 46 (or other agitation material in the case of a non-microfiber brushroll), and prevents cleaning fluid from being sucked into the suction inlet 60 immediately after being distributed from the fluid dispenser 38. The suction guard 164 does not seal against the brushroll 46, and working air can still move through the porous nap (or other agitation material) of the brushroll 46 so that at least some suction is present at a forwardmost portion of the of the brush chamber 62, e.g. between the cover 188 and the brushroll 46.

The suction guard 164 is mounted at a rearward portion of the brush chamber 62 and is configured to interface with a portion of the brushroll 46, as defined by the rotational direction R, which has just passed the suction inlet port 60. The suction guard 164 is generally below the dispenser 38, such that the portion brushroll 46 to be wetted by the dispenser 38 is above the suction guard 164. Optionally, the suction guard 164 can be a laterally-elongated rib disposed above the axis 174 of the brushroll 46 generally parallel to the surface to be cleaned. The rib can have a length equal to, less than, or greater than the length of the brushroll 46, Other locations and configurations for the suction guard 164 in relation to the brushroll 46 and/or fluid dispenser 38 are possible.

In the present embodiment, the suction guard 164 is integrated with the fluid dispenser 38, and may in particular be integrally molded with the spray manifold 130 and formed project forwardly of the front side 138 of the manifold 130. In other embodiments, the suction guard 164 is not integrated with, and may be provided separately from, the fluid dispenser 38.

The suction guard 164 can be rigid, i.e. stiff, and non-flexible, so the suction guard 164 does not yield or flex by engagement with the brushroll 46. Optionally, the wiper 176 can be formed of rigid thermoplastic material, such as poly(methyl methacrylate) (PMMA), polycarbonate, or acrylonitrile butadiene styrene (ABS).

The brushroll 46 can be configured to be removed by the user from the base 14, such as for cleaning and/or drying the brushroll 46. The brushroll 46 can be removably mounted in the brush chamber 62 by a brushroll latch 184, a portion of which can be provided in the brush chamber 62, with a mating portion provided on a non-rotatable portion of the brushroll 46. The non-rotatable portion can include a grip 186 to aid in removal of the brushroll 46 from the brush chamber 62.

Referring to FIGS. 11-12, in one aspect of the disclosure, the base 14 can have a cover 188 removably coupled to the base housing 90 and at least partially defining the brush chamber 62. An interior surface of the cover 188 can define the brush chamber 62, with the interior surface of the cover 188 proximate to the brushroll 46. As such, the cover 188 forms a portion of the recovery path 50, with the suction inlet port 60 being open to the chamber 62 defined by the cover 188. At least a portion of the cover 188 can be formed from a translucent or transparent material, such that the brushroll 46 is at least partially visible to a user through the cover 188.

The cover 188 can be curved generally in a forward and downward direction to extend over a top side and front side of brushroll 46. The cover 188 can wrap around and in front of the brushroll 46 to define a front of the base 14 at an exterior side therein and to define a front of the brush chamber 62 at an interior side thereof.

Optionally, the interference wiper 176 is mounted at an interior forward side of the cover 188, and projects into the brush chamber 62. A bumper 190 can be provided on the cover 188, such as at a lower front edge thereof, opposite the interference wiper 176.

A portion of the base housing 90 can define the rearward side 138 of the brush chamber 62, with the suction inlet port 60 provided near a middle of the rearward side 138. The cover 188 can define a forward side 194 and upper side 196 of the brush chamber 62.

The cover 188 can be removable from the base housing 90 without the use of tools. Optionally, the base 14 can have a cover latch that releasably secures the cover 188 on the base housing 90. In one embodiment, the cover latch comprises two spring-mounted latch actuators 198 that are pinched together to release the cover 188. The latch actuators 198 slides inward, in opposing directions, from a latched position to an unlatched position, thereby allowing removal of the brushroll cover 188. Other cover latches are possible.

The cover 188 may be releasable from the base 14 in a linear or a pivotable movement as desired. The brushroll cover 188 may be separated from the base 14 in the opened position or may be connected to the base 14 in the opened position. The latch actuators 198 can also be used to lift the cover 188 away from the base housing 90.

The base 14 can include a headlight that illuminates a surface to be cleaned, exterior of the base 14. In one embodiment, the headlight includes a light guide 202 (e.g. a light pipe) that transmits or conveys light from an internal light source 204 to the floor surface in front of the base. The cover 188, in certain embodiments, can include the light guide 202, and the light source 204 may be disposed within the base housing 90.

Figure 13:
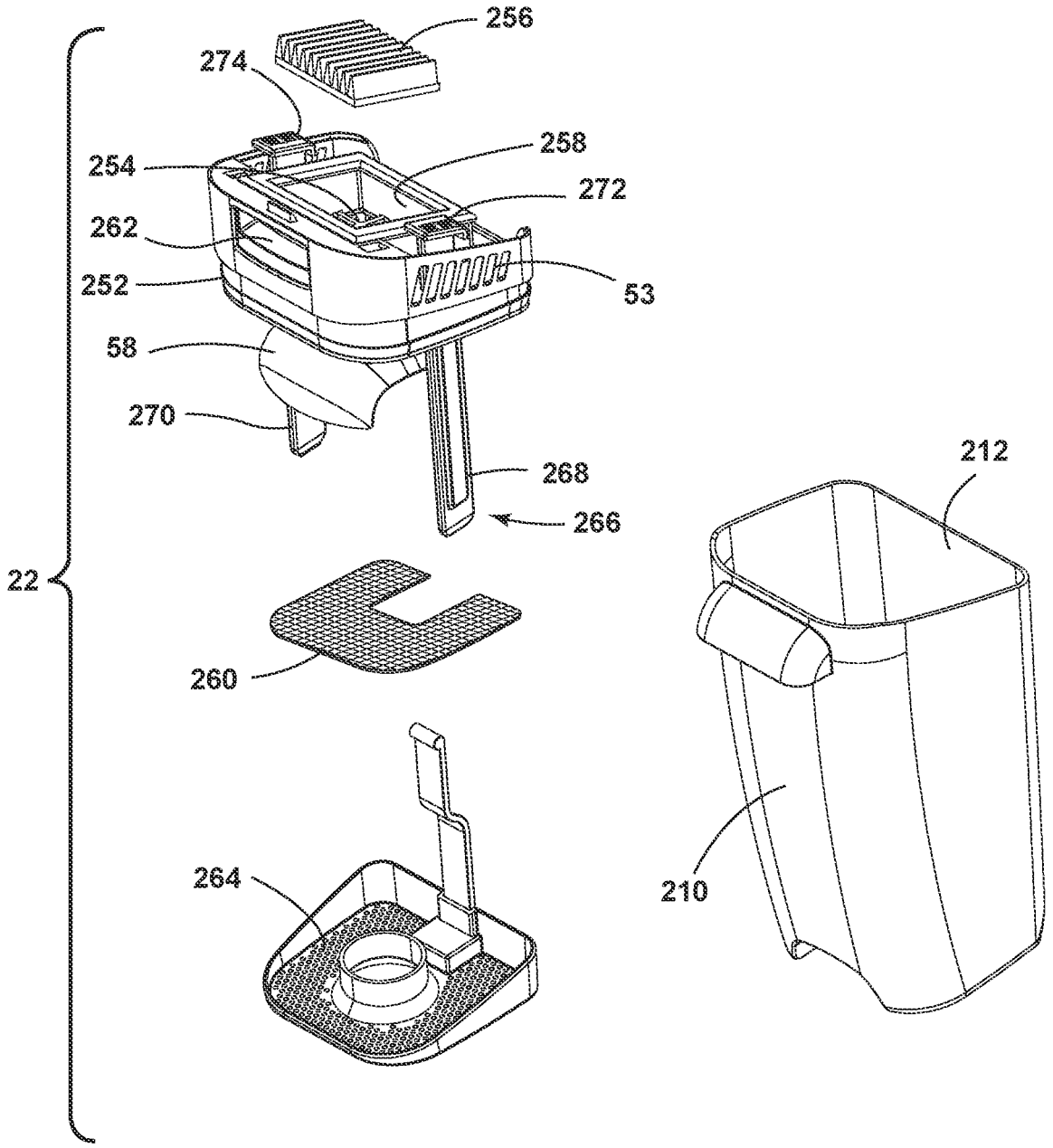
FIG. 13 is a partially exploded perspective view of a recovery tank of the apparatus.
Figure 14:
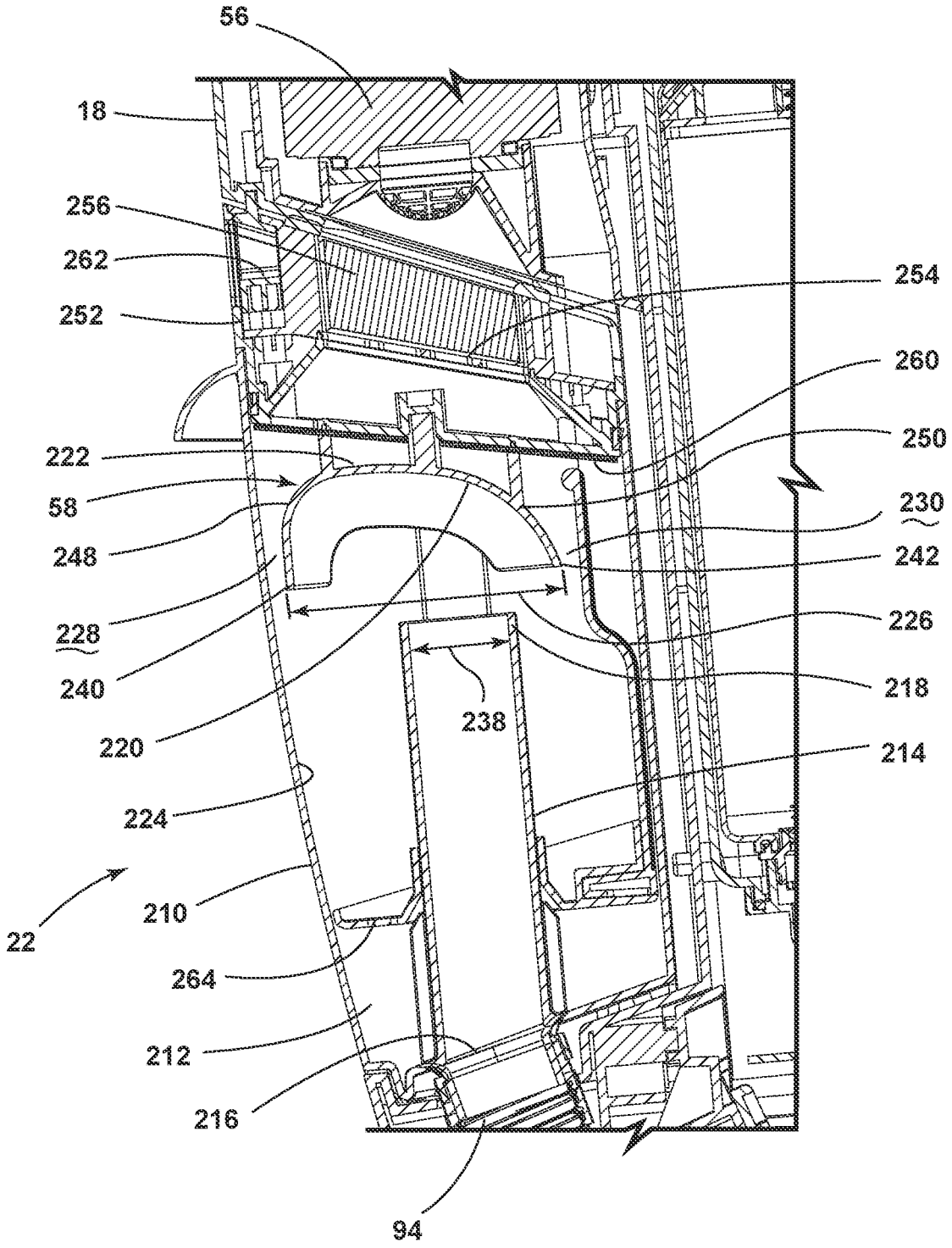
FIG. 14 is a cross-sectional view taken through line III-III of FIG. 1, enlarged to show aspects of the recovery tank.

FIG. 13 is a partially exploded perspective view of one embodiment of the recovery tank 22 and FIG. 14 is a close-up, cross-sectional view showing the recovery tank 22. The recovery tank 22 can include a recovery tank container 210, which forms a collection chamber 212 for the recovery system, with a hollow standpipe 214 therein. The standpipe 214 can be oriented such that it extends generally upwardly within the tank container 210 in the mounted position of the tank 22. The standpipe 214 forms a flow path between a tank inlet 216 formed at a lower end of the tank container 210 and an opening 218 at the upper end of the standpipe 214 within the interior of the tank container 210. When the recovery tank 22 is mounted to the frame 18 as shown in FIG. 14, the inlet 216 is aligned with the conduit 94 to establish fluid communication between the base 14 and the recovery tank 22. The standpipe 214 can be integrally formed with the tank container 210, or may be separated formed and attached thereto.

As briefly discussed above, the tank 22 can include a separator in the form of a baffle 58 configured to separate liquid and/or debris from a working airstream entering the recovery tank 22. The baffle 58 is a diverter or other deflecting feature that guides the working airstream towards the interior tank volume near the front, rear and sides of the tank, where the velocity of the working airstream decreases such that the liquid and/or debris is separated out of the working airstream and collected in the collection chamber 212 near the sides and/or bottom of the tank 22.

The baffle 58 is preferably positioned such that at least a portion of an incoming stream of dirty fluid will impact the baffle 58, i.e., will contact the underside 220 of the baffle 58, upon exiting the standpipe 214. This may help cause the dirty fluid stream to change direction relatively quickly and reduce velocity, which may tend to help separate liquids and/or debris from the working airstream. The separated liquids and debris may collect in the container 210, while the remaining portion of the incoming working airstream can continue downstream, optionally to another separator and/or filter, as described below.

The baffle 58 is spaced from an inner surface 224 of the tank container 210, such spacing forming at least one flow gap between the baffle 58 and the tank container 210 to allow airflow through the container 210. In one configuration, the baffle 58 has a first or transverse width 226 in the transverse direction (e.g. from front-to-back in the orientation of FIG. 14), which stops short of the front and rear walls of the container 210 to form a forward flow gap 228 and a reward flow gap 230. The baffle 58 has a second or lateral width 232 in the lateral direction (e.g. from side-to-side in the orientation of FIG. 15), which stops short of the side walls of the container 210 to form side flow gaps 234, 236. The flow gaps 228, 230, 234, 236 can be continuous with each other, forming one generally annular flow gap that extends around a perimeter of the baffle 58 and the inner surface 224 of tank container 210. The width of the flow gap 228, 230, 234, 236 may increase or decrease about the perimeter of the baffle 58.

Figure 15A:
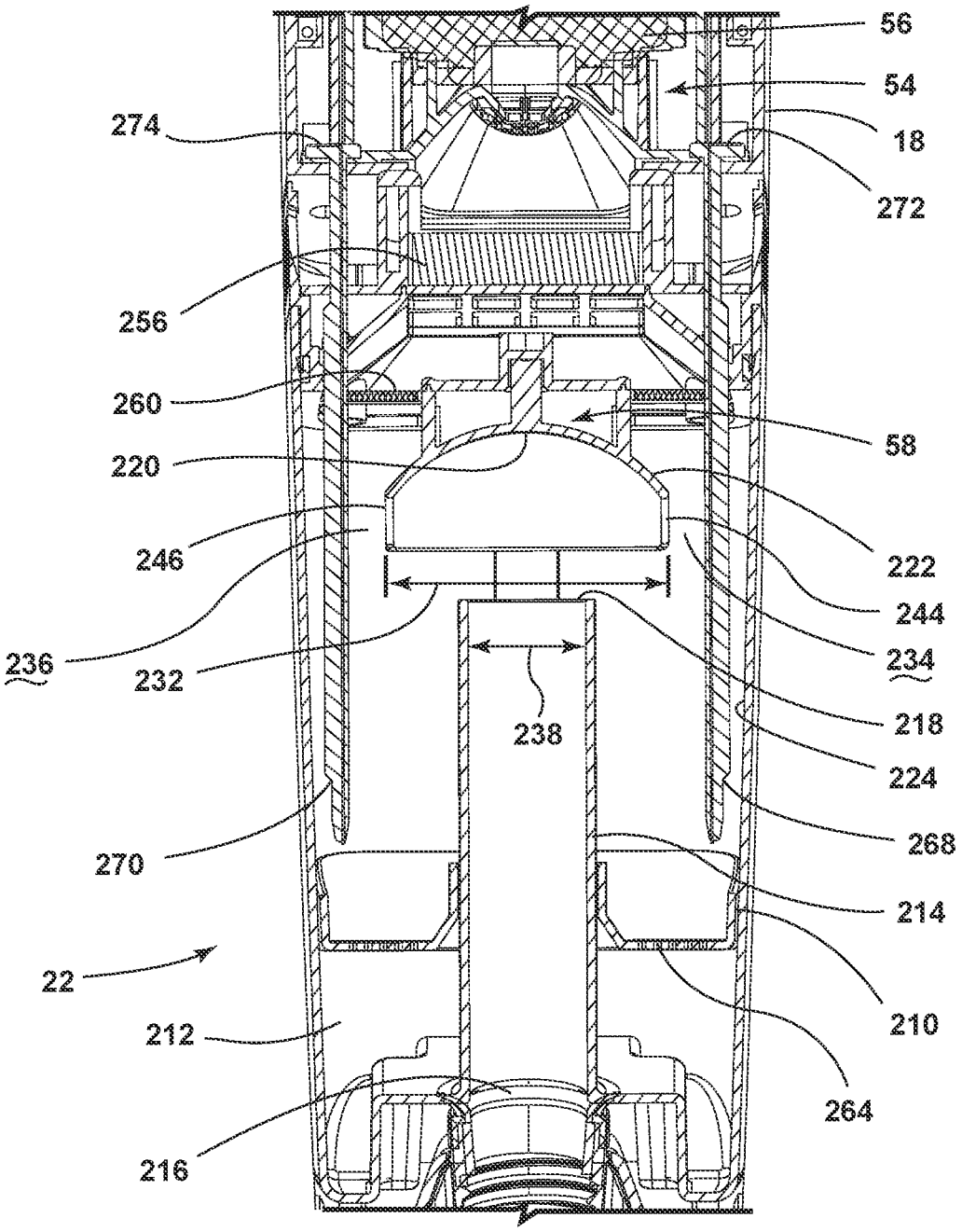
FIG. 15A is a cross-sectional view taken through line XV-XV of FIG. 1, enlarged to show aspects of the recovery tank.

The baffle size can be selected so that the baffle 58 can cover the entire standpipe opening 218, including from the front to the back as shown in FIG. 14 and from side-to-side as shown in FIG. 15. Thus, the first width 226 and the second width 232 of the baffle 58 may be greater than a diameter 238, or other corresponding dimension, of the standpipe opening 218.

The baffle 58 can comprise a curved deflector surface 222, which defines the 220 of the baffle 58, and which is spaced from and faces the opening 218 of the standpipe 214. The curvature of deflector surface 222 may be extend in a front-to-back direction, such as shown in FIG. 14, and/or in side-to-side direction, such as shown in FIG. 15. In other embodiments, the deflector surface 222 may have one or more straight or angled portions relative to the opening 218.

The deflector surface 222 has a forward edge 240, a rearward edge 242, and side edges 244, 246. The edges 240-246 may define the perimeter of the baffle 58, and are spaced inwardly from the inner surface 224 of the tank container 210.

In one embodiment, the baffle 58 is offset relative to the standpipe opening 218 to resist debris accumulation at the rear of the tank 22. The offset may be in the form of a lateral offset, a transverse offset, a vertical offset, or any combination thereof. In one embodiment, and referring to FIG. 14, the forward edge 240 of the deflector surface 222 is disposed farther from the standpipe 214 than the rearward edge 242 to provide a transverse offset on a forward side of the tank 22. To provide a vertical offset on a forward side of the tank 22, the deflector surface 222 angles upwardly in a forward direction, and may additionally have a sharper forward curved portion 248 on a forward end of the baffle 58, e.g. approaching the forward edge 240, and a gentler rearward curved portion 250 on a rearward end of the baffle 58, e.g. approaching the rearward edge 242. This transverse and vertical offset encourages debris to flow up and away from the standpipe 214, and toward the front side of the tank 22. Referring to FIG. 15, the side edges 244, 246 of the deflector surface 222 are disposed equidistant from the standpipe 214, which encourages debris to flow toward both lateral sides of the tank 22. In another embodiment, the baffle 58 may have a lateral offset to encourage more to flow toward one lateral side of the tank 22. In yet another embodiment, the baffle 58 may have a transverse offset without a vertical offset, or a vertical offset without a transverse offset, and achieve an improved clog resistance, though possibly lesser in comparison to a baffle with both a transverse and vertical offset.

To minimize debris buildup on the underside of the baffle 58, the deflector surface 222 can have a smooth curvature. The constant washing action of incoming flow against the smoothly-curved surface 222 contributes to keeping the baffle 58 free of debris. Further, the exposed top surfaces of the baffle 58 can be smoothly (and downwardly) curved to allow debris to fall off easily.

During operation, the tank 22 is typically reclined rearwardly due to the recline of the upright body 12. Therefore, without a baffle, or with a baffle that directs debris equally in multiple directions, debris tends to collect at the rear of the tank 22 and may clog the tank 22 before it is actually at capacity. The offset baffle 58 gently directs debris downward toward the front and sides of the tank 22, and away from the back wall of the tank 22, and preventing over-accumulation of debris at the rear of the tank 22 to resist clogging.

Referring to FIG. 13, the recovery tank 22 includes a lid 252 sized for receipt on the tank container 210. The lid 252 at least partially encloses an open top of the tank container 210, and can further define an air outlet 254 of the recovery tank 22 leading to the downstream suction source 54 (FIG. 15).

The recovery tank 22 can include at least one filter downstream of the baffle 58 for separation of finer debris from the working airstream. In one embodiment, a motor filter (or pre-motor filter) 256 is provided at the air outlet 254, and may in particular be provided on a downstream side of the air outlet 254. The filter 256 can be supported by the lid 252 and the lid 252 can include a filter receiver 258 on an upwardly-facing side thereof that is sized to removably receive the filter 256. The air outlet 254 can be disposed within and/or defined by the filter receiver 258.

In one embodiment, the motor filter 256 comprises a pleated filter media, and can be made of a material that remains porous when wet. In another embodiment, the filter 256 comprises a foam filter media.

In addition to the motor filter 256, the tank 22 can include a pre-filter 260 that blocks some debris from reaching the motor filter 256, thereby keeping more debris in the tank container 210 and out of the motor filter area. The pre-filter 260 is disposed on an upstream side of the air outlet 254, e.g. a side facing the tank container 210, and is preferably supported by the lid 252 for removal therewith. In one embodiment, the pre-filter 260 can comprise a mesh configured to filter a larger particle size than the motor filter 256. Fine debris may be stopped at the pre-filter 260, while ultrafine debris is stopped by the motor filter 256.

The baffle 58 can be coupled with the lid 252 for removal therewith from the tank container 210. The baffle 58 is thereby independent of, e.g. unconnected to or not supported by, the standpipe 214. The tank lid 252 can include a support structure that holds the baffle 58, and which may also support one or both of the motor filter 256 and the pre-filter 260. Removal of the lid 252 to empty the container 210 thereby removes the baffle 58 and filters 256, 260.

A recovery tank latch 262 can optionally be supported by the lid 252 for securing the recovery tank 22 to the upright body 12 within the recovery tank receiver 114, shown in FIG. 14. The latch 262 can be configured to releasably lock the recovery tank 22 to the upright body 12, such that a user must actuate the latch 262 before pulling the tank 22 off the frame 18. In another embodiment, the latch 262 can releasably latch or retain, but not lock, the tank 22 on the frame 18, such that a user can conveniently apply sufficient force to the tank 22 itself to pull the tank 22 off the frame 18.

The recovery tank 22 can further include a removable strainer 264 configured to strain large debris and hair out of the tank container 210 prior to emptying. The strainer 264 is configured to collect the large debris and hair while draining liquid and smaller debris back into the tank container 210. One example of a suitable strainer is disclosed in U.S. Patent Application Publication No. 2019/0159646, filed Nov. 30, 2017, which is incorporated herein by reference in its entirety. For purposes of this description, large debris are any debris with a maximum dimension, such as a length or diameter, of greater than or equal to 0.5 mm to 6 mm, and preferably 3 mm, whereas small debris are any debris having a maximum dimension, such as a length or diameter, of less than that of the larger debris. An example of a piece of large debris includes a strand of hair with a length greater than 3 mm. Examples of small debris include coffee grounds and crumbs with diameters less than 3 mm.

Figure 15B:
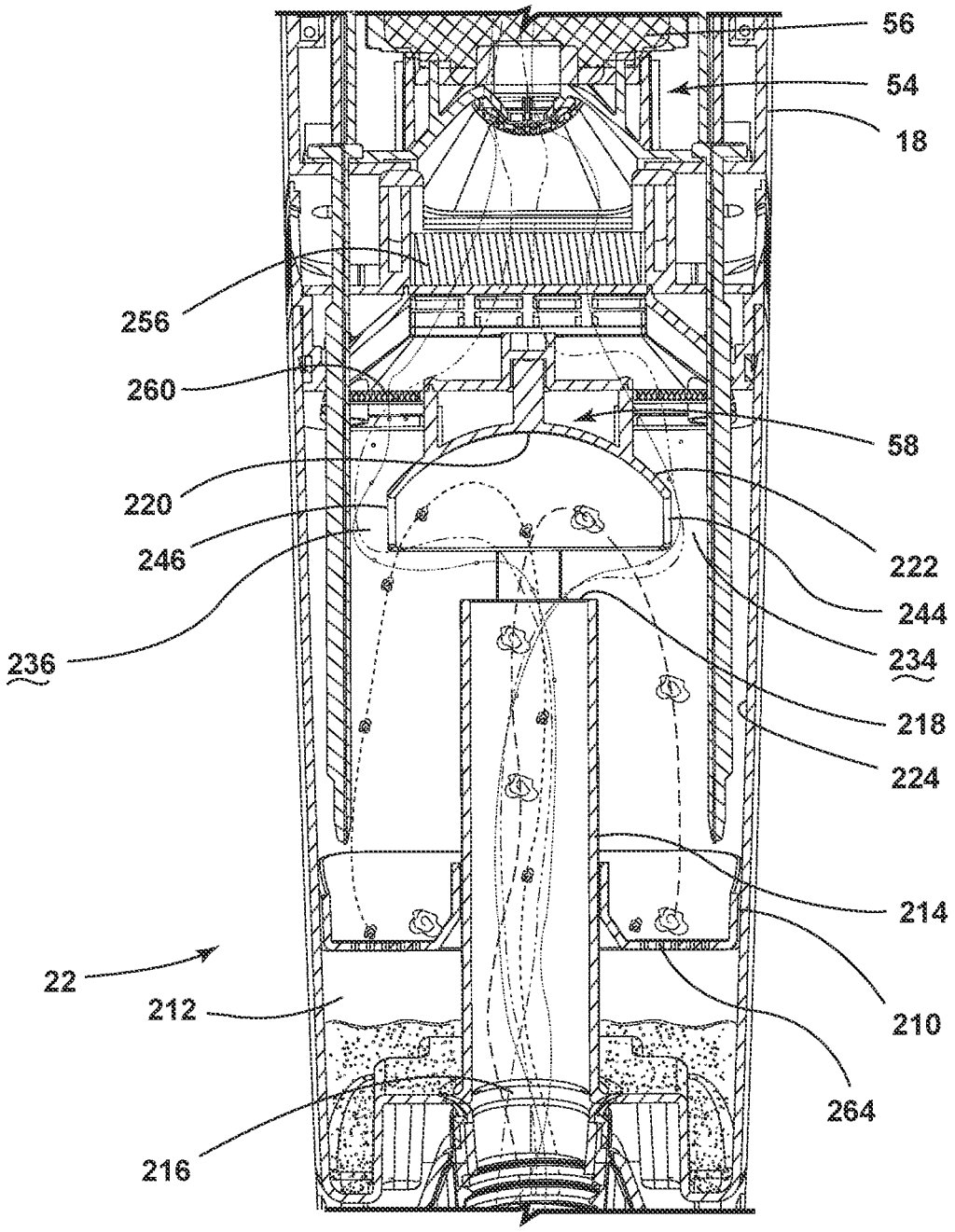
FIG. 15B is a view similar to FIG. 15A, showing a working air flow path through the recovery tank generally indicated by dashed lines, where the working air comprises a debris-and-liquid-laden air stream.

In FIG. 15B, a working air flow path through the tank 22, which defines a portion of the recovery pathway, is generally indicated by dashed lines. Working air, which may have entrained debris and/or liquid and comprise a debris-laden and/or liquid-laden air stream, enters through the standpipe 214 and encounters the baffle 58. Some debris and/or liquid may fall to the bottom of the tank 22 after directly impacting the baffle 58, while other debris and/or liquid may be separated by a reduction in air speed. By significantly slowing down the air speed after entering the tank 22, large debris and liquid droplets can no longer be carried in the working air path, and fall out of the working air path to the bottom of the tank 22, with the baffle 58 directing debris and liquid toward the front and sides of the tank 22. After being deflected by the baffle 58, the working air proceeds relatively slowly upward toward the top of the container 210 and exits the container 210 through the air outlet 254 in the lid 252. Fine debris is captured by the pre-filter 260 and ultrafine debris is captured by the motor filter 256. Relatively clean, filtered, and/or liquid-free air passes to the suction source 54.

In one embodiment, the recovery tank 22 can have a liquid level sensing system 266 configured to detect liquid at one or more levels within the recovery tank 22 and determine when to shut-off or otherwise interrupt the recovery system. In addition, the sensing system 266 can detect whether the recovery tank 22 is missing from the apparatus 10.

The sensing system 266 can include any suitable components for sensing liquid within the recovery tank 22. One example of a suitable floatless tank and sensing system is disclosed in U.S. Patent Application Publication No. 2021/0267428, filed Dec. 15, 2020, which is incorporated herein by reference in its entirety. The '428 publication further discloses a system and method for sensing foam in the tank 22, which can be provided on the apparatus 10 shown herein. In another embodiment, the tank 22 can comprise a float-style shut off.

In the illustrated example, the sensing system 266 includes sensors or probes 268, 270 that can detect liquid. The probes 268, 270 can be electrically coupled with power terminals 272, 274, optionally provided on the lid 252, which couple with electrical contacts (not shown) on the recovery tank receiver 114 when the recovery tank 22 is mounted on the frame 18 to supply power to the probes 268, 270. The electrical contacts on the recovery tank receiver 114 are electrically coupled with a power source of the apparatus 10, e.g. battery 66.

The probes 268, 270 can be supported by the lid 252, and can be offset from the standpipe 214 and baffle 58. When the lid 252 is coupled to the container 210, the probes 268, 270 project into the collection chamber 212. It is further contemplated that sensors can be molded directly into the side walls of the container 210, thereby eliminating the probes.

The sensor probes 268, 270 are coupled with the controller 72 (FIG. 2). One sensor 268 can emit a liquid sensing signal that is detected by the other sensor 270. If the signal indicates that the liquid in the recovery tank 22 is at or above a critical level, the controller 72 can turn off the at least one electrical component of the apparatus 10. Such components can include the vacuum motor 56, and optionally also the pump 44 and/or the brush motor 64. In another configuration, the controller 72 can additionally or alternatively activate a shut-off valve (not shown) in response to the signal to prevent liquid ingress into the suction source 54.

In one aspect of the disclosure, the recovery tank 22 defines a first upstream portion of the recovery path 50 (FIG. 2) upstream of the vacuum motor 56 and defines a second portion of the recovery tank 22 downstream of the vacuum motor 56. For example a portion of the working air exhaust path downstream of the vacuum motor 56 extends through a portion of the recovery tank 22. In one embodiment, the recovery tank 22 can have at least one exhaust vent defining the outlet 53 of the recovery path 50 e.g. a clean air outlet for the floor cleaner. In the illustrated embodiment, two exhaust vents 53 are provided on the opposing sides of the recovery tank 22, although other numbers and locations for the exhaust vents are possible. In one embodiment, the exhaust vents 53 are incorporated into the lid 252 of the recovery tank 22.

Figure 16:
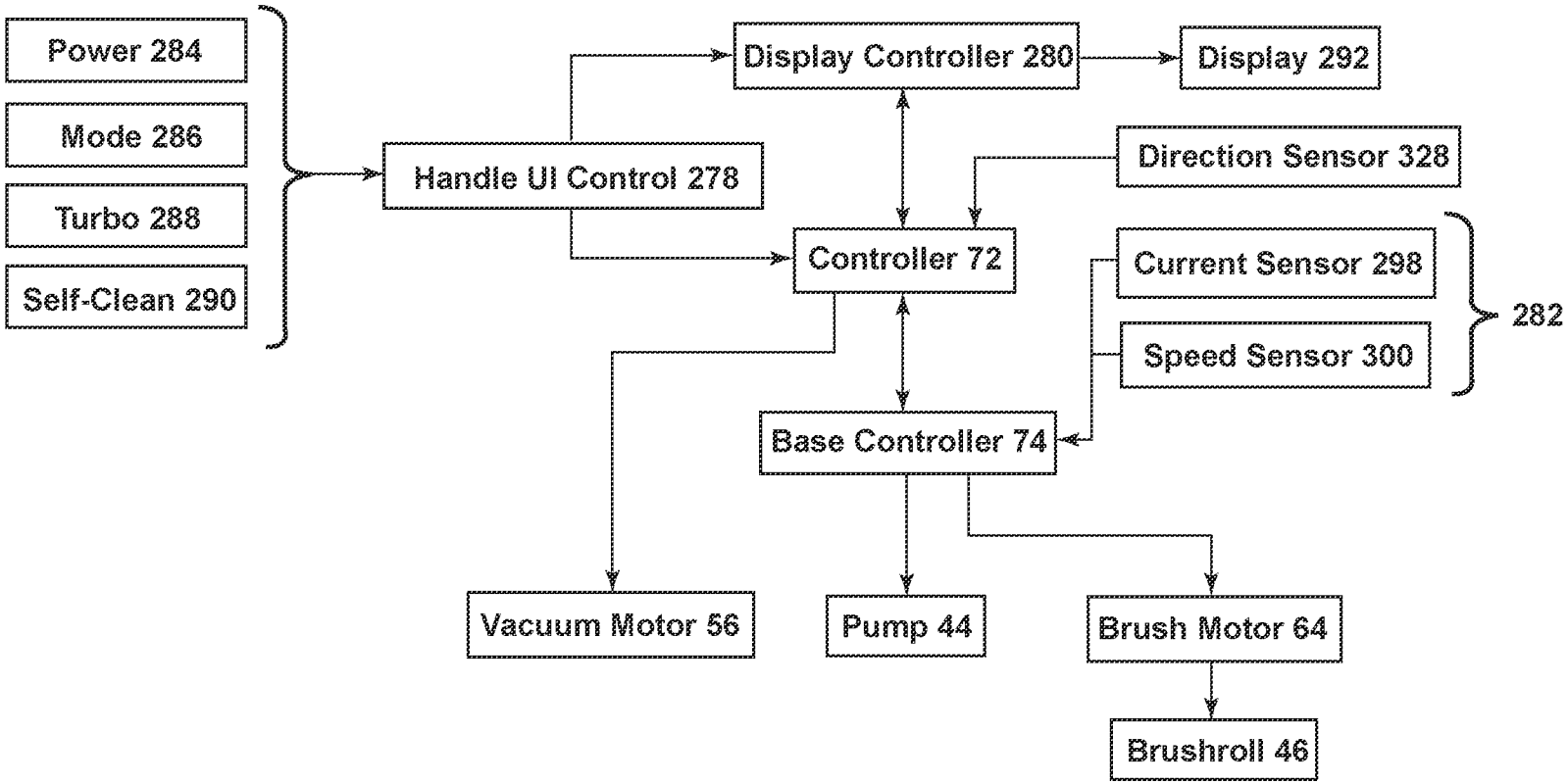
FIG. 16 is a block diagram of a portion of the electrical components of the apparatus.

FIG. 16 is a block diagram of a portion of the electrical components of the apparatus 10. The main controller 72 is operably coupled with at least the vacuum motor 56, the pump 44, and the brush motor 64. The controller 42 is also operably coupled with the base PCB 74, a handle controller 278 of the handle UI 30, and a display controller 280 of the display UI 32. The controllers 278, 280 may comprise PCBs, and may alternatively be referred to herein as handle PCB 278 and display PCB 280, respectively. The controller 72 is also operably coupled to one or more sensing components, such as the recovery tank level sensing system 266 (shown in FIG. 13) and a floor type sensing mechanism 282, described in further detail below.

The apparatus 10 can include a wireless communication module, e.g. a Wi-Fi module, that can wirelessly communicate with an external device such as networked cloud device, a smartphone, or a tablet. The Wi-Fi module can detect the presence of a Wi-Fi network, signal strength, unique router identification data, or any combination thereof, and can connect the apparatus 10 to the internet via a local Wi-Fi network. The Wi-Fi module can be integrated with the main controller 72. Wi-Fi network connection status can be shown on the display UI 32.

The first UI 30 can include one or more input controls 284, 286, 288, 290 in register with the handle PCB 278. One input control can comprise an on/off button, e.g. a power button 284, to control the supply of power to one or more electrical components of the apparatus 10. For example, the power button 284 and activate and de-active the vacuum motor 56 and the brush motor 64. By default, pressing the power button 284 can turn on both motors 56, 64, and operate the apparatus 10 in the dry vacuuming mode. Other default modes for the apparatus 10 are possible, including a wet default mode or a default mode in which pressing the power button 284 activates an electronic component of the apparatus 10 other than the motors 56, 64.

Another input control can be a mode button 286 to select between different modes when the apparatus 10 is on. For example, repeated pressing of the mode button 286 can cycle between dry cleaning and wet cleaning. In another example, repeated pressing of the mode button 286 can cycle between dry cleaning, wet cleaning, and self-cleaning, or any combination thereof, and in any order thereof.

Another input control can be a turbo button 288 to activate an intense cleaning mode, as described in further detail below. The turbo button 288 may operate a momentary switch that is closed only as long as the user depresses the button 288. Therefore, upon release of the turbo button 288, the turbo mode ends and the apparatus 10 can automatically revert to the previous, e.g. non-turbo, mode.

Another input control can be a self-clean button 290 to activate and de-active a self-cleaning mode of the apparatus 10 in which the apparatus 10 executes an automatic, unattended clean-out cycle. In one aspect of the disclosure, operation of the self-cleaning mode may require that the apparatus 10 be docked on the tray 70 (FIG. 1) and/or another condition for self-cleaning be met. When not docked and/or when another condition for self-cleaning is not met, the clean-out cycle may be inoperable, e.g., selection of the self-clean button 290 will not activate the self-cleaning mode. In other embodiments, a separate self-clean button is not provided, and self-cleaning mode can be initiated via the mode button 286.

The display UI 32 includes a display 294, such as, but not limited to, an LED matrix display or a touchscreen. The display 294 can include multiple status indicators informing a user of various detailed apparatus information, such as, but not limited to, the current cleaning mode (i.e., hard floor, area rug, dry vacuuming, turbo, self-cleaning), battery status, Wi-Fi connection status, supply fluid level, supply tank presence, dirty fluid level, recovery tank presence, filter status, floor type, or any combination thereof. The status indicators can be a visual display, and may include any of a variety of lights, such as LEDs, textual displays, graphical displays, or any variety of known status indicators. The UI 32 may also include a speaker (not shown).

In one aspect of the disclosure, the apparatus 10 can have multiple, user-selectable cleaning modes, such as at least one wet cleaning mode, at least one dry cleaning mode, and a self-cleaning mode. The modes can have associated operating parameters for the pump 44, vacuum motor 56, and/or brushroll motor 64. In one embodiment, the apparatus 10 has multiple dry cleaning modes and multiple wet cleaning modes, and these cleaning modes may include a dry vacuuming mode, a hard floor wet mode, an area rug wet mode, and at least one turbo mode.

In one embodiment of the dry vacuuming mode, the vacuum motor 56 and brush motor 64 are activated, and the vacuum motor 56 operates at a first power level and the brush motor 64 operates at a first speed. In the dry vacuuming mode, cleaning fluid is not dispensed, and the pump 44 is deactivated. The dry vacuuming mode is selected using the mode button 286.

In one embodiment of the hard floor mode, the vacuum motor 56, pump 44, and brush motor 64 are activated, and the vacuum motor 56 operates at a first power level and the pump 44 dispenses cleaning fluid at a first flow rate from the fluid dispenser 38. As described in further detail below, with the apparatus 10 set to wet cleaning using the mode button 286, the hard floor mode may be auto-selected based on floor type. In another embodiment, the hard floor mode may be user-selected using the mode button 286.

In one embodiment of the area rug mode, the vacuum motor 56, pump 44, and brush motor 64 are activated, and the pump 44 dispenses cleaning fluid at a second flow rate from the fluid dispenser 38. The second flow rate can be higher than the first flow rate of the hard floor mode. For example, in the area rug mode, cleaning fluid can be dispensed at a rate at least 2× that of the hard floor mode. The vacuum motor 56 can operate at a second power level, which can be higher than the first power to provide greater suction performance by the apparatus 10 in the area rug mode. In another embodiment, the second power level is the same as the first power level of the hard floor mode. As described in further detail below, with the apparatus 10 set to wet cleaning using the mode button 286, the area rug mode may be auto-selected based on floor type. In another embodiment, the area rug mode may be user-selected using the mode button 286.

The turbo mode may be initiated with the apparatus 10 in the dry vacuuming mode, the hard floor mode, or the area rug mode. In the turbo mode, the vacuum motor 56 can operate at a higher power level than that of the currently-selected mode to provide the greatest suction performance by the apparatus 10. The brush motor 64 can operate at a higher speed that that of the currently-selected mode to provide greater agitation. Optionally, when the currently-selected mode is a wet mode, the flow rate may be increased, remain the same, or reduced in the turbo mode. The turbo mode is selected using the turbo button 288.

In one embodiment of the self-cleaning mode, the apparatus 10 executes an automatic, unattended clean-out cycle. During the clean-out cycle, the vacuum motor 56, pump 44, and brush motor 64 are activated in an automated sequence, and cleaning fluid is sprayed on the brushroll 46, the brushroll 46 rotates, and fluid is extracted and deposited into the recovery tank 22, thereby also flushing out the brush chamber 62 and the recovery path 50. The vacuum motor 56, pump 44, and brush motor 64 can be active individually or simultaneously, and for any predetermined times, including overlapping and non-overlapping times. For example, the vacuum motor 56, pump 44, and brush motor 64 can be activated at once. In another example, the pump 44 and brush motor 64 can be activated for a first predetermined period, and the vacuum motor 56 activated after. In yet another example, the pump 44 can be activated for a first predetermined period, the brush motor 64 can be activated for a second predetermined period after the pump 44 is de-activated, and the vacuum motor 56 activated during or after activation of the pump 44 and/or brush motor 64. Yet other clean-out cycles are possible. The self-cleaning mode can be configured to last for a predetermined amount of time or until the cleaning fluid in the supply tank 20 has been depleted.

By way of non-limiting example, in one self-cleaning mode, the pump 44 and brush motor 64 are activated for 10 seconds, then the brush motor 64 remains on for an additional 10 seconds while the pump 44 is de-activated to spin the brushroll 46 without additional fluid delivery, and finally the brush motor 64 remains on for an additional 20 seconds while vacuum motor 56 is activated. In total, the clean-out cycle lasts for 40 seconds.

While the operating parameters may vary, in one example during the self-cleaning mode, the vacuum and brush motors 56, 64 can operate at the same parameters as the dry vacuuming and/or hard floor mode, and the pump 44 can operate at a higher flow rate to flush out the recovery pathway.

Table 1 below lists some non-limiting examples of operating parameters for the modes. Other operating parameters for the modes and other cleaning modes are possible.

TABLE 1

| Mode | Pump | Vacuum Motor | Brush Motor |
|---|---|---|---|
| Dry Vacuuming | OFF | LOW | LOW |
| Turbo Dry | OFF | HIGH | HIGH |
| Hard Floor Wet | LOW | LOW | LOW |
| Area Rug Wet | HIGH | MED | LOW |
| Turbo Wet | MED | HIGH | HIGH |
| Self-Cleaning | HIGH | LOW | LOW |

Table 2 below lists some non-limiting examples of operating parameter values for the modes, including a preferred value and a range for some parameters. Other operating parameters for the modes are possible.

TABLE 2

| Mode | Pump Flow Rate (ml/min) | | Vacuum Motor Suction Power (W) | Brush Motor Speed (RPM) | |
|---|---|---|---|---|---|
| Dry Vacuuming | 0 | | 90 | 900 | 750-1100 |
| Turbo Dry | 0 | | 150 | 1100 | 900-1100 |
| Hard Floor Wet | 40 | 30-50 | 90 | 900 | 750-1100 |
| Area Rug Wet | 100 | 75-100 | 110 | 900 | 750-1100 |
| Turbo Wet | 75 | 75-100 | 150 | 1100 | 900-1100 |
| Self-Cleaning | 100 | 75-100 | 90 | 900 | 750-1100 |

In all wet cleaning modes (e.g. user-operated or attended modes), the release of cleaning fluid can be continuous or automatic, e.g. does not require pressing a trigger, and may be controlled based on floor type. In an alternative embodiment, release of cleaning fluid can be manually controlled by the user, for example using a trigger. In the unattended self-cleaning mode, the release of cleaning fluid is automatic.

Figure 17:
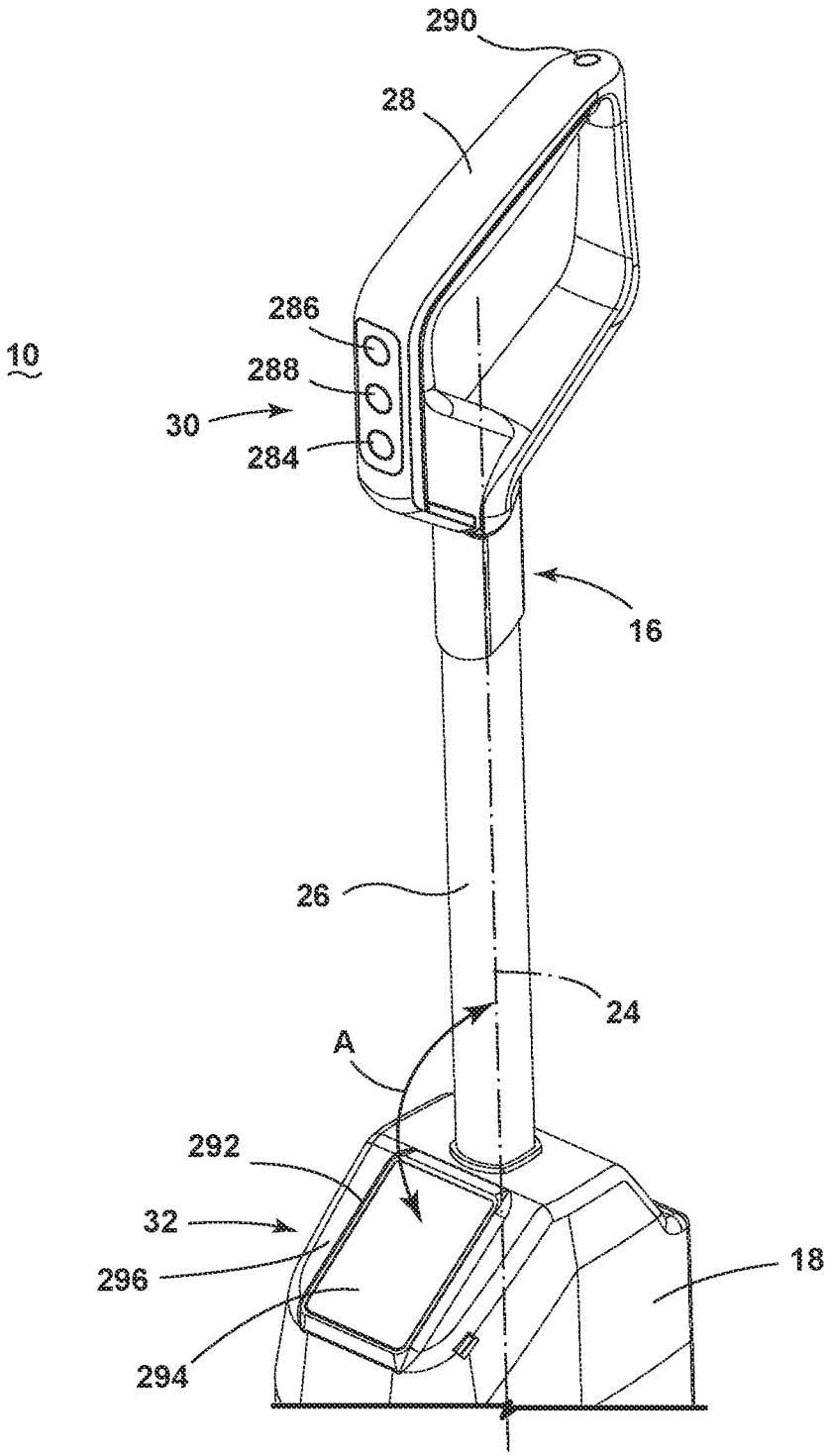
FIG. 17 is a perspective view showing one user interface configuration for the apparatus.

FIG. 17 shows one configuration of the U Is 30, 32 for the floor cleaner 10, along with the handle 16 and a portion of the frame 18. For the handle UI 30, various arrangements of the buttons 284, 286, 288, 290 are possible. In one embodiment, the buttons 284, 286, 288, 290 are arranged accordingly to a predetermined frequency of use, with the mode button 286 disposed highest on a front side of the grip 28, e.g. closest to the user, followed by the turbo button 288, and the power button 284 disposed lowest on the grip 28, e.g. farthest from the user. The self-clean button 290 can be separate from the other buttons, and may be disposed on an upper rear portion of the grip 28.

During operation, the user can select the mode button 286 to toggle through multiple cleaning modes. With the arrangement of the UI 30 on the handle 16 the user can conveniently hold the handle grip 28 in one hand, and use the thumb of the same hand to depress the mode button 286 and/or turbo button 288 until a desired mode is initiated. The selected cleaning mode may displayed by the second UI 32.

The second UI 32 and its display 294 can be located on the frame 18. To increase visibility of the UI 32 from multiple perspectives and reduce glare, the UI 32 can be angled. With the UI 32 disposed at an angle, the UI 32 can be observed from the perspective of a user in the typical operating position behind the apparatus 10 with the upright body 12 reclined (FIG. 3) and from the perspective of a user approaching the apparatus 10 from the front or side with the upright body 12 parked/stored (FIGS. 1 and 17).

The display 294 has an exterior or visible surface 294 and is supported on an angled wall 296 of the frame 18. The angled wall 296 is generally below the handle 16, on a front side of the frame 18.

In one embodiment, the display 294, alternatively its visible surface 294, is disposed at an angle A of 115-135 degrees, alternatively 125 degrees, relative to the handle axis 24.

Referring to FIG. 16, in one aspect of the disclosure the apparatus 10 is provided with a floor type sensing mechanism 282 including at least one floor type sensor. By detecting whether the floor type under the apparatus is a hard surface or a soft surface, a cleaning mode can be set and/or at least one operating parameter of the apparatus 10 can be adjusted. The main controller 72 receives input from the floor type sensor, and may operate an electrical component of the apparatus 10 based on such input. The controller 72 may continuously or periodically receive sensor input, and may adjust or update the operating parameters when the floor type changes.

The controller 72 may operate the vacuum motor 56 based on a floor type. For example, the controller 72 may operate the vacuum motor 56 at a lower power on a hard surface to conserve energy or a higher power on a soft floor surface to increase liquid and debris pick-up.

The controller 72 may operate the brush motor 64 based on a floor type. For example, the controller 72 may operate the brush motor 64 at a lower speed on a hard surface to reduce debris scattering or a higher speed on a soft surface to increase agitation.

The controller 72 may operate the pump 44 based on a floor type. For example, the controller 72 may operate the pump 44 at a lower flow rate on a hard surface to reduce cleaning fluid application or a higher flow rate on a soft surface to increase cleaning fluid application.

In one embodiment, the floor type sensing mechanism 282 comprises at least one brush sensor 298, 300. The brush sensor is a sensor that senses a parameter related directly or indirectly to an aspect of the brushroll 46. The floor type sensing mechanism can use this parameter to infer the current floor type. The brush sensor can be a speed sensor for sensing a revolutions per minute (RPM) value of the brushroll 46, a speed sensor for sensing an RPM value of the brushroll motor 64, an electrical senor for sensing an electrical parameter (e.g., current or voltage) of the brushroll motor 64, a torque sensor for sensing a torque parameter of the brushroll motor 64, etc. Other non-brush floor type sensors may be used, such as, but not limited to, a time-offlight sensor, ultrasonic sensor, an accelerometer, a pressure sensor, an optical sensor, or any combination thereof.

It is contemplated that multiple floor type sensors can provide information (e.g., signals, data) used to determine or infer the floor type. For example, the floor type sensing mechanism 282 may require signals from both a motor current sensor and a motor speed sensor to infer a floor type.

Figure 18:
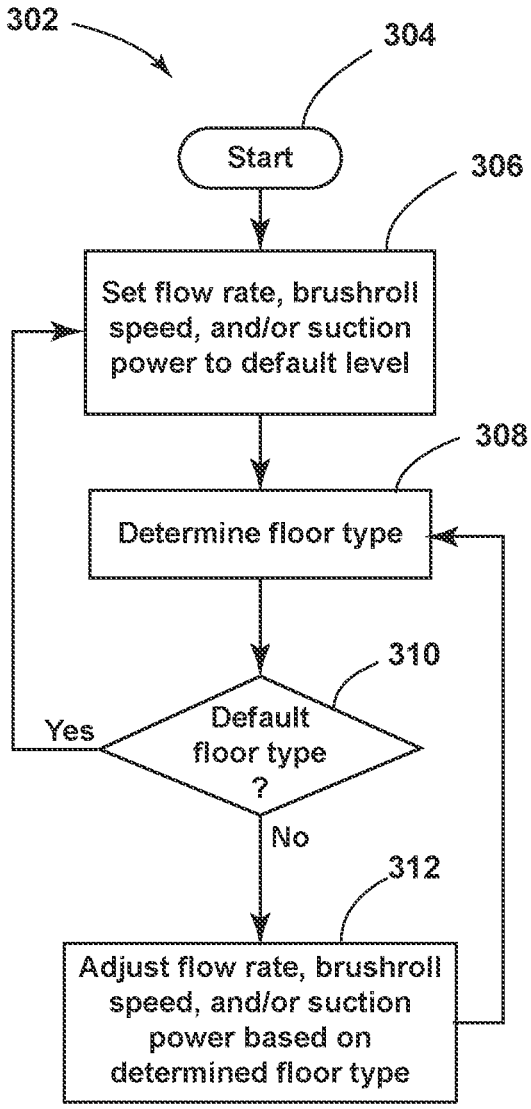
FIG. 18 illustrates an exemplary process for operating a surface cleaning apparatus in accordance with one or more floor-type sensing techniques.

FIG. 18 illustrates an exemplary process 302 for operating a surface cleaning apparatus 10 in accordance with one or more floor-type sensing techniques. According to the process 302, and with additional reference to FIG. 16, the apparatus 10 is powered on (304), for example by pressing power button 284, and at least one operating parameter of the apparatus 10 is set to a default level (306). Such operating parameters may include, but are not limited to, cleaning fluid flow rate, brushroll speed, and suction power. The floor type is determined (308) based on input from the floor type sensing mechanism 282. Such determination may include a direct determination or an inference based determination, and may be performed by onboard computing device, e.g., by the main controller 72, the base controller 74, a combination thereof. One a floor type determination is made, the controller 72 determines (310) whether the floor type is the default type, (e.g., the type corresponding to the default operating parameter(s), or whether the floor type has changed, and whether to adjust (312) at least one operating parameter of the apparatus 10. Adjusting at least one operating parameter of the apparatus 10 may include adjusting the cleaning fluid flow rate, the brushroll speed, the suction power, or any combination thereof.

Referring back to FIG. 16, in one aspect of the disclosure, the floor type sensing mechanism 282 includes a current sensor 298 that measures a current draw of the brush motor 64 and a speed sensor 300 that measures a speed of the brush motor 64. The base PCB 74 can receive and processes the sensor data, and may calculate a torque value that is communicated to the main controller 72. Alternatively, the main controller 72 can perform the receiving, processing and/or calculation.

Figure 19:
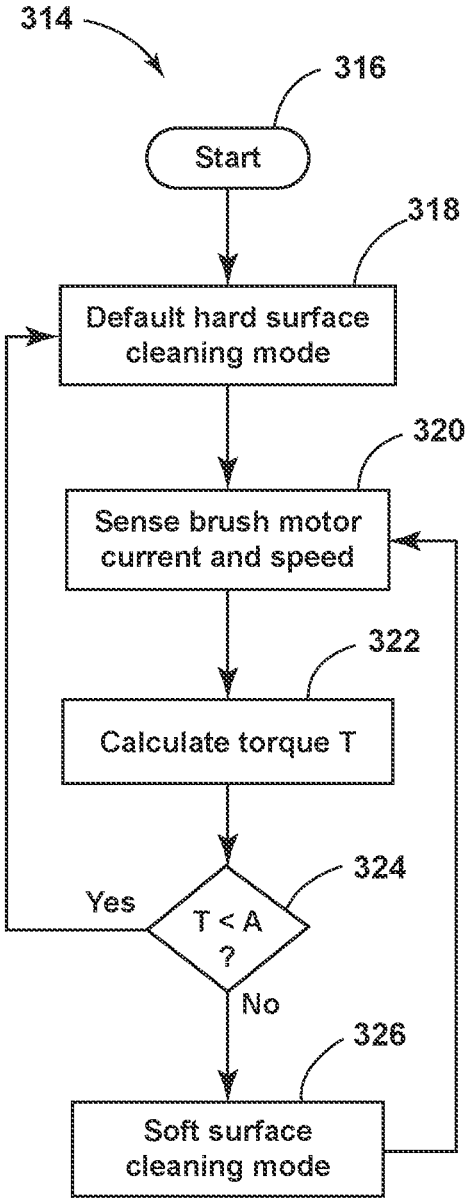
FIG. 19 illustrates an exemplary process for operating a surface cleaning apparatus in accordance with torque sensing.

FIG. 19 illustrates an exemplary process 314 for operating a floor cleaning apparatus in accordance with torque sensing; According to the process 314, and with additional reference to FIG. 16, the apparatus 10 is powered on (316), for example by pressing power button 284, and operates in a default cleaning mode (318). The default cleaning mode may be a cleaning mode, wet or dry, in which the operating parameters are defaulted to hard floor. The current draw and speed of the brush motor 64 is sensed (320) and the controller 72 calculates (322) a torque value T from the sensed current and speed. The calculated torque value T is compared (324) with a reference value A stored in a memory of the apparatus 10, with the reference value A representing a threshold between hard and soft floor types. For example, traversing a soft surface (e.g. a carpeted floor) will generally force the brushroll motor 64 to work harder (i.e., generate higher torque), while traversing a hard surface (e.g. a wood or tile floor) will allow the brushroll motor 64 to work more easily (i.e., generate lower torque). If the calculated torque value T is found to be less than the reference value A, the currently traversed floor type can be inferred as the default floor type, e.g. a hard surface, and the apparatus 10 continues operating in the default mode (318). If the calculated torque is found to be greater than the reference value A, the currently traversed floor type can be inferred as a soft surface. The controller 72 updates the cleaning mode to the soft surface cleaning mode (326), and may adjust operating parameters of the pump 44, the vacuum motor 56, and/or the brush motor 64.

While steps 320-324 of the process 314 calculate and use torque on the brush motor 64 to infer the floor type, other methods of inferring or determining floor type may be used. For example, in another embodiment, floor type is determined based on current alone, and toque is not calculated.

Figure 20:
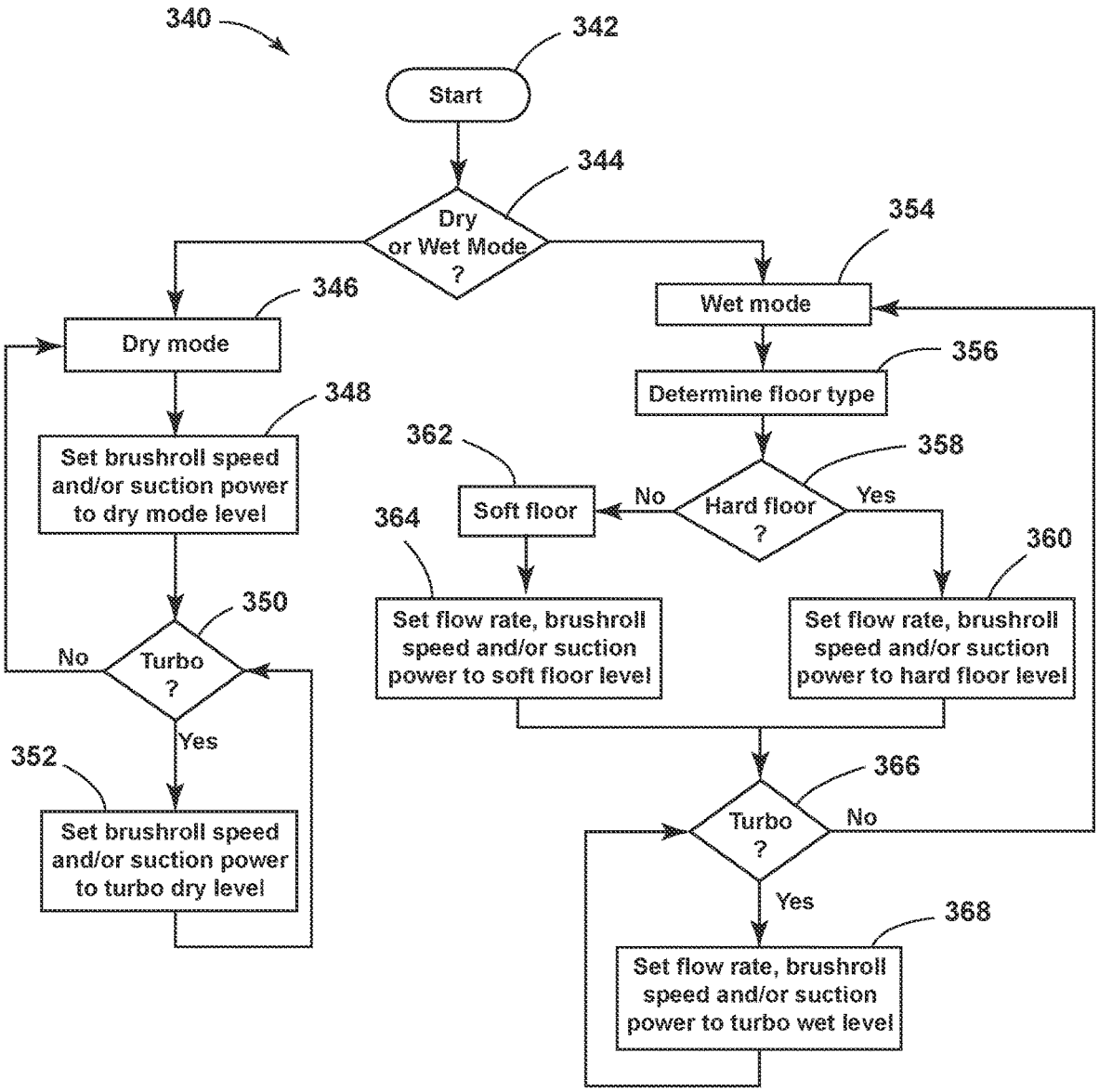
FIG. 20 illustrates an exemplary process for operating a surface cleaning apparatus in accordance with one or more mode selection and floor-type sensing techniques.

FIG. 20 illustrates another exemplary process 340 for operating a floor cleaning apparatus in accordance with one or more mode selection and floor-type sensing techniques. According to the process 340, and with additional reference to FIG. 16, the apparatus 10 is powered on (342), for example by pressing power button 284, and may operate in a default cleaning mode or may wait for user-selection of a cleaning mode (344), for example by pressing mode button 286. It is noted that, at any time during process 340, the user can switch between dry and wet cleaning by pressing mode button 286.

With the selection of dry cleaning (346), brushroll speed and suction power are set to a dry mode level (348) via control of the brush motor 64 and vacuum motor 54. For example, the apparatus 10 may operate in the dry vacuuming mode with operating parameters according to Table 1 or Table 2, and otherwise disclosed herein. With the selection of the turbo mode (350), for example by pressing turbo button 288, brushroll speed and/or suction power are increased (352). For example, the apparatus 10 may operate in the turbo dry mode with operating parameters according to Table 1 or Table 2, and otherwise disclosed herein.

With the selection of wet cleaning (354), the apparatus 10 enters a smart wet cleaning process, where operating parameters are set based on floor type. The floor type is determined (356) based on input from the floor type sensing mechanism 282. When the floor type is known, a suitable wet cleaning mode, e.g., a hard surface cleaning mode or a soft surface cleaning mode, can subsequently be set so that the surface can be optimally cleaned. Alternatively, instead of or in addition to setting a wet cleaning mode, at least one operating parameter of the apparatus 10 can be set or adjusted. In certain embodiments, fluid dispensing flow rate, brushroll speed, and suction power level can be set based on the detected floor type during wet cleaning.

If the floor type is determined to be hard floor (358), flow rate, brushroll speed and suction power are set to hard surface levels (360) via control of the pump 44, brush motor 64, and vacuum motor 54. For example, the apparatus 10 may operate in the hard floor wet mode with operating parameters according to Table 1 or Table 2, and otherwise disclosed herein.

If the floor type is determined to be soft floor (362), flow rate, brushroll speed and suction power are set to soft surface levels (364) via control of the pump 44, brush motor 64, and vacuum motor 54. For example, the apparatus 10 may operate in the area rug wet mode with operating parameters according to Table 1 or Table 2, and otherwise disclosed herein.

With the selection of the turbo mode (366) during wet cleaning of either floor type, for example by pressing turbo button 288, brushroll speed and/or suction power are increased (368), and the flow rate may increase, remain the same, or may decrease to conserve energy. For example, the apparatus 10 may operate in the turbo dry mode with operating parameters according to Table 1 or Table 2, and otherwise disclosed herein.

The turbo button 288 may operate a momentary switch that is closed only as long as the user depresses the button 288. Therefore, upon release of the turbo button 288, the operating parameters can automatically revert to the standard levels for the dry or wet mode.

Referring to FIG. 16, in one aspect of the disclosure, the apparatus 10 may be configured to shut off cleaning fluid dispensing on a backward stroke of the apparatus 10, which can minimize streaking on the floor surface. In one typical use operation, the user stands behind the apparatus 10 and maneuvers the apparatus 10 back and forth across surface to be cleaned. The travel direction the apparatus 10 hence changes. For example, on a forward stroke, the user exerts a pushing force on the apparatus 10 to move the apparatus in a forward direction across the surface being cleaned. On a rearward stroke, the user exerts a pulling force on the apparatus 10 to move the apparatus in a rearward direction across the surface to be cleaned.

In one embodiment, the apparatus 10 has a direction sensor 328 that determines a travel direction of the apparatus 10, e.g. whether the apparatus 10 is moving in a forward stroke or a backward stroke. The main controller 72 receives input from the direction sensor 328, and may control the pump 44 based on such input. For example, the controller 72 may deactivate the pump 44 on a backward stroke of the apparatus 10 and may activate the pump 44 on a forward stroke of the apparatus 10. When activated, the pump 44 may operate at the flow rate for the currently-selected cleaning mode, e.g. at the hard floor rate in the hard floor mode and at the soft floor rate in the area rug mode. The controller 72 may continuously or periodically receive direction sensor input, and may turn the pump 44 on/off when the direction changes accordingly. The direction sensor 328 can comprise, but is not limited to, an accelerometer or a wheel rotation sensor.

Figure 21:
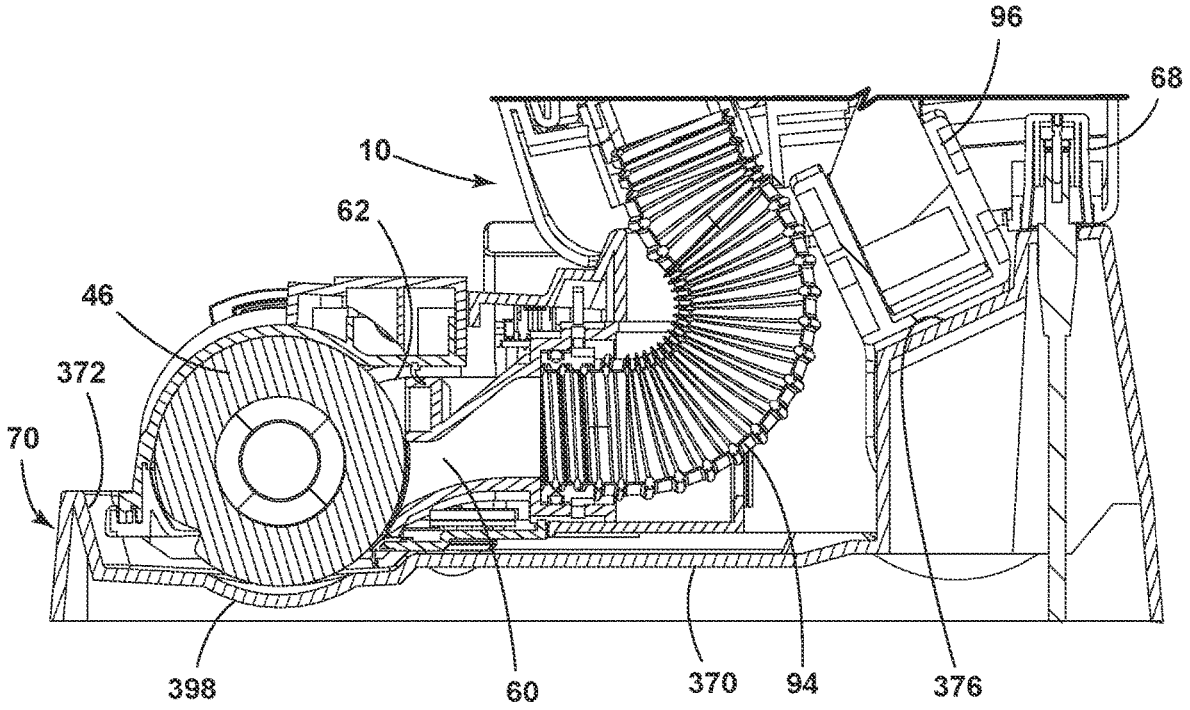
FIG. 21 is a cross-sectional view taken through line III-III of FIG. 1, enlarged to show aspects of the tray.

FIG. 21 is a cross-sectional view showing the apparatus 10 docked on the tray 70. The tray 70 can include a tray base 370 and guide walls 372 extending upwardly from the tray base 370 that help to align the base 14 within the tray 70. A rear portion of the tray 70 can include a supporting rest 376 extending upwardly and configured to help align the base 14 within the tray 70 and prevent the floor cleaner 10 from tipping backward. For example, the joint assembly 96 and the supporting rest 376 can possess complementary shapes, with a rear side of the joint fitting against the rest 376.

In some embodiments, the tray 70 can function as a cleaning tray during the self-cleaning mode. Self-cleaning using the tray 70 can save the user considerable time and may lead to more frequent use of the floor cleaner 10. The tray 70 can have a recessed portion in the form of a sump 378 in register with at least one of the brush chamber 62 and brushroll 46. Optionally, the sump 378 can create a closed loop between the fluid delivery and recovery systems of the floor cleaner 10 to flush out a portion of the recovery pathway between the suction inlet port 60 and the recovery tank 22 during self-cleaning, including the conduit 94.

FIGS. 22-25 show a recovery tank 22A having a lid 252A in accordance with another aspect of the disclosure. The recovery tank 22A can have a tank container 210A, baffle 58A, motor filter 256A, pre-filter 260A and as previously described (see FIGS. 13-15). The lid 252A is sized for receipt on the tank container 210A, and at least partially encloses an open top of the tank container 210A.

The tank lid 252A can include a support structure 380 that holds the baffle 58A, and which may also support one or both of the motor filter 256A and the pre-filter 260A. The support structure 380 defines the air outlet 254A of the recovery tank 22A leading to the downstream suction source 54 (FIG. 2). In one embodiment, the support structure 380 is a single, injection molded part designed to lack inaccessible cavities that would hold water and/or debris.

The lid 252A can comprise a gasket 382 sealing the interface between the recovery tank 22A and the frame 18 (FIG. 5). In one embodiment, the gasket 382 can compress the tank 22A, frame 18, and pre-filter 260A together to seal against air and water leaks at the interfaces therebetween. The gasket 382 can support the support structure 380 in the tank container 210A.

Figure 25:
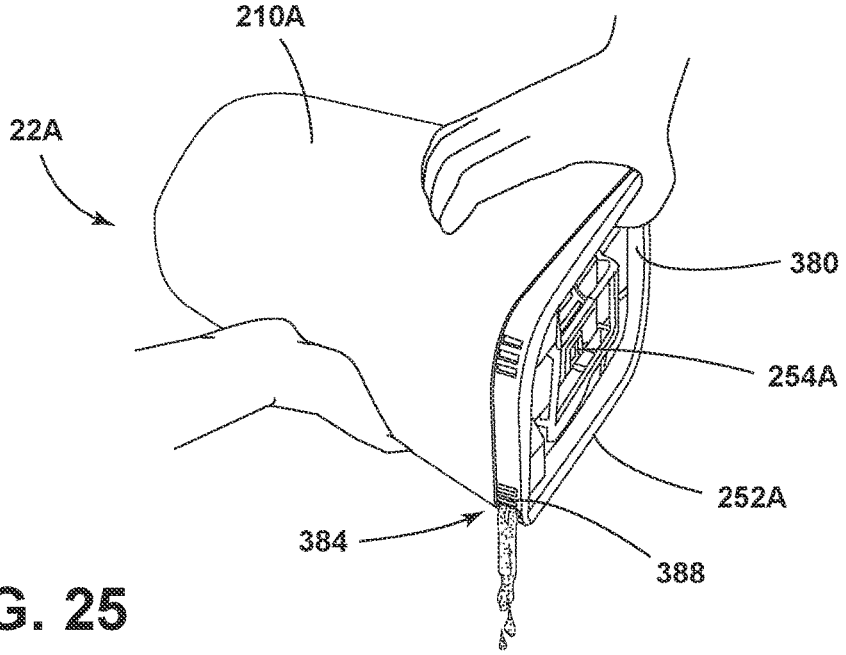
FIG. 25 is a viewing showing the lid straining the contents of the recovery tank during emptying.

The lid 252A can comprise an integrated strainer 384 configured to strain large debris and hair out of the tank 22A during emptying, and prior to removal of the lid 252A from the tank container 210A. For example, as shown in FIG. 25, the strainer 384 retains large debris and hair within the tank 22A while pouring liquid and smaller debris out of the tank container 210A. Optionally, the motor filter 256A can be removed from the lid 252A prior to straining the contents of the tank 22. After straining the contents of the tank 22, the lid 252A can be removed from the container 210A, and any remaining debris can be emptied out of the container 210A.

In one embodiment, the strainer 384 is integral with the support structure 380, and may, for example, comprise a plurality of drain holes 388 in a side wall 386 of the support structure 380. The drain holes 388 shown herein are rectangular openings or apertures through the side wall surface 386. Other embodiments of drain holes 388 are possible, including circular or other non-circular openings or apertures. Still further, other embodiments of the strainer 384 can have a grid or mesh on the lid 252A defining the drain holes 388. In one non-limiting example, a maximum dimension (e.g., height, width, or diameter) of the drain holes 388 can be about 0.5 mm to 6 mm.

To make pouring easier, the drain holes 388 can be grouped at a corner of the tank 22, with the corner of the tank 22 acting as a spout or funnel directing liquid down toward the drain holes 388. To make pouring easier for both right-handed and left-handed users, a set of drain holes 388 can be provided at multiple corners of the tank 22.

Figure 22:
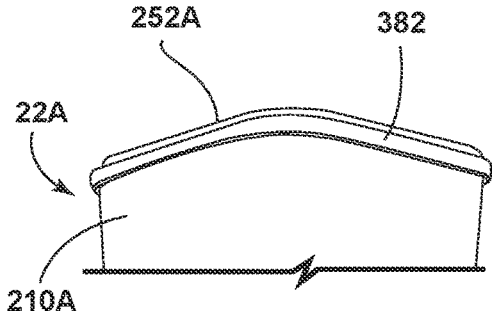
FIG. 22 is a partial perspective view showing another recovery tank, with a lid of the tank in a closed or sealed position.
Figure 23:
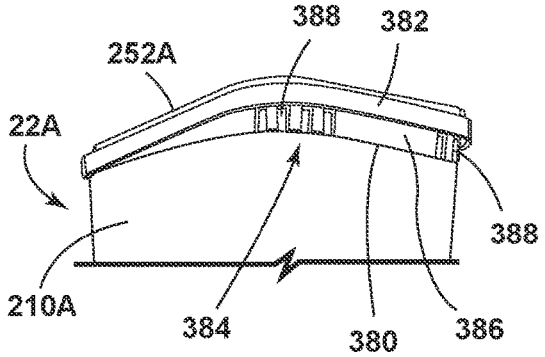
FIG. 23 is a view similar to FIG. 22, showing the lid in an open or straining position.
Figure 24:
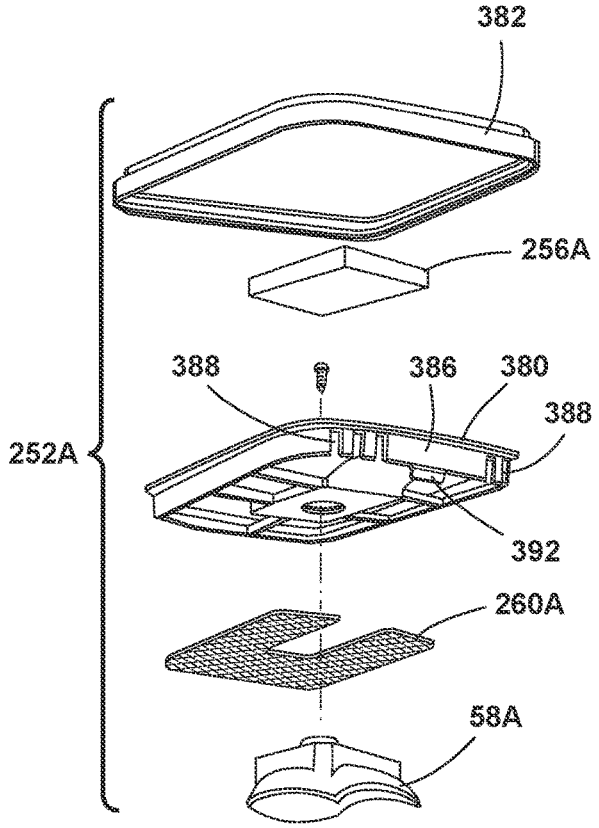
FIG. 24 is an exploded view of the lid of the recovery tank of FIG. 22.

FIG. 22 shows the lid 252A in a closed or sealed position and FIG. 23 shows the lid 252A in an open or straining position. In the closed/sealed position, the lid 252A is inserted into the container 210A, and the strainer 384 is covered. The gasket 382 can help hold the lid 252A in the closed/sealed positon via friction against the tank container 210. The tank 22 is thus ready for installation on the apparatus 10. In the open/straining position, the lid 252A is partially extended from the container 210A to expose the strainer 384. Preferably, the lid 252A remains at least partially retained on the tank container 210A in this position. The lid 252A can have a tab 392 that holds or retains the lid 252A in the open/straining position, but still allows separation of the lid 252A from the tank container 210A after straining to empty and any remaining debris.

To the extent not already described, the different features and structures of the various embodiments of the invention, may be used in combination with each other as desired, or may be used separately. That one surface cleaning apparatus is illustrated herein as having all of these features does not mean that all of these features must be used in combination, but rather done so here for brevity of description. Thus, the various features of the different embodiments may be mixed and matched in various vacuum cleaner configurations as desired to form new embodiments, whether or not the new embodiments are expressly described.

Furthermore, while the apparatus 10 shown herein has an upright configuration, the surface cleaning apparatus can be configured as a canister surface cleaning apparatus or a hand-held surface cleaning apparatus. Still further, the surface cleaning apparatus can additionally have steam delivery capability. Thus, the various features of the different embodiments may be mixed and matched in various vacuum cleaner configurations as desired to form new embodiments, whether or not the new embodiments are expressly described.

The terms "comprising" or "comprise" are used herein in their broadest sense to mean and encompass the notions of "including," "include," "consist(ing) essentially of," and "consist(ing) of. The use of "for example," "e.g.," "such as," and "including" to list illustrative examples does not limit to only the listed examples. Thus, "for example" or "such as" means "for example, but not limited to" or "such as, but not limited to" and encompasses other similar or equivalent examples.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

The invention claimed is:

1. A surface cleaning apparatus comprising:
an upright body comprising a handle and a frame;
a base operably coupled to the upright body;
an agitator provided with the base;
a fluid delivery system comprising:
a supply tank removable from the frame, the supply tank adapted to hold a supply of cleaning fluid; and
a fluid dispenser provided with the base, the fluid dispenser in fluid communication with the supply tank; and
a recovery system comprising:
a recovery pathway;
a recovery tank removable from the frame and forming a portion of the recovery pathway;
a suction source; and
a suction inlet port provided with the base and in fluid communication with the suction source, wherein the suction inlet port is configured to simultaneously ingest fluid and debris through the recovery pathway;
wherein the recovery tank comprises a standpipe and a baffle that directs fluid and/or debris out of a working airstream to a side and/or a bottom of the recovery tank; and
wherein the recovery tank comprises a strainer and a removable lid, and the strainer is integrated with the lid.

2. The surface cleaning apparatus of claim 1 wherein the baffle is coupled to and removable with the lid.

3. The surface cleaning apparatus of claim 1, wherein the baffle comprises a baffle wall with a curved lower surface spaced above an upper end of the standpipe, the upper end of the standpipe comprising a standpipe outlet opening in fluid communication with a tank inlet at the bottom of the recovery tank.

4. The surface cleaning apparatus of claim 1, wherein the baffle comprises a forward edge and a rear edge, wherein the forward edge is disposed farther from the standpipe than the rear edge.

5. The surface cleaning apparatus of claim 4, wherein the baffle comprises a deflector surface having a sharper forward curved portion approaching the forward edge and a gentler rearward curved portion approaching the rear edge.

6. The surface cleaning apparatus of claim 3, wherein the baffle is offset relative to the standpipe opening.

7. The surface cleaning apparatus of claim 1, wherein the baffle is spaced from an inner surface of the recovery tank, such spacing forming at least one flow gap between the baffle and the recovery tank.

8. A surface cleaning apparatus comprising:
an upright body comprising a handle and a frame;
a base operably coupled to the upright body;
an agitator provided with the base;
a fluid delivery system comprising:
a supply tank removable from the frame, the supply tank adapted to hold a supply of cleaning fluid; and
a fluid dispenser provided with the base, the fluid dispenser in fluid communication with the supply tank; and
a recovery system comprising:
a recovery pathway;
a recovery tank removable from the frame and forming a portion of the recovery pathway;
a suction source; and
a suction inlet port provided with the base and in fluid communication with the suction source, wherein the suction inlet port is configured to simultaneously ingest fluid and debris through the recovery pathway;
wherein the recovery tank comprises a standpipe and a baffle that directs fluid and/or debris out of a working airstream to a side and/or a bottom of the recovery tank; and
wherein the recovery tank comprises a pre-filter fluidly downstream of the baffle and a motor filter fluidly downstream of the pre-filter.

9. A surface cleaning apparatus comprising:
an upright body comprising a handle and a frame;
a base operably coupled to the upright body;
an agitator provided with the base;
a fluid delivery system comprising:
a supply tank removable from the frame, the supply tank adapted to hold a supply of cleaning fluid; and
a fluid dispenser provided with the base, the fluid dispenser in fluid communication with the supply tank; and
a recovery system comprising:
a recovery pathway;
a recovery tank removable from the frame and forming a portion of the recovery pathway;
a suction source; and a suction inlet port provided with the base and in fluid communication with the suction source, wherein the suction inlet port is configured to simultaneously ingest fluid and debris through the recovery pathway;

wherein the recovery tank comprises a standpipe and a baffle that directs fluid and/or debris out of a working airstream to a side and/or a bottom of the recovery tank; and wherein the fluid dispenser comprises a spray manifold having an inlet and a supply chamber supplying cleaning fluid to a plurality of outlets, wherein the cross-section of the supply chamber decreases in a direction away from the inlet.

10. The surface cleaning apparatus of claim 1, comprising a rechargeable battery selectively powering the suction source, wherein the rechargeable battery is disposed within the frame and is further at least one of:

disposed above the supply tank;

disposed above the recovery tank;

disposed rearwardly of the recovery tank;

disposed rearwardly of a handle axis of the handle; and disposed on a rear side of the frame.

11. The surface cleaning apparatus of claim 10, comprising a battery housing provided on the frame, wherein the rechargeable battery is selectively removable from the battery housing, wherein the battery housing is disposed above the supply tank and isolates the rechargeable battery from a fluid delivery pathway of the fluid delivery system.

12. The surface cleaning apparatus of claim 10, wherein the supply tank is at least one of:

disposed below the rechargeable battery;

disposed rearwardly of the recovery tank;

disposed rearwardly of a handle axis of the handle; and disposed on a rear side of the frame.

13. The surface cleaning apparatus of claim 1, comprising a supply tank receiver provided on the frame, the frame having a rear side in which an opening to the supply tank receiver is disposed, wherein the supply tank is selectively removable from the supply tank receiver and wherein the supply tank has at least one surface forming a portion of the rear side of the frame when mounted in the supply tank receiver.

14. The surface cleaning apparatus of claim 1, wherein the base includes a brushroll cover defining an underside that is adjacent to the agitator, the brushroll cover defining a brush chamber that forms a portion of the recovery pathway, with the suction inlet port in fluid communication with the brush chamber.

15. The surface cleaning apparatus of claim 1, comprising a moveable joint assembly mounting the base to the upright body, wherein the upright body is pivotable via the joint assembly between an upright storage position and a reclined use position, wherein the recovery pathway comprises a suction conduit passing from the base to the upright body, and wherein the suction conduit is disposed outside the moveable joint assembly, and optionally wherein the suction conduit is disposed forwardly of the moveable joint assembly.

16. The surface cleaning apparatus of claim 1, comprising a floor type sensor and a controller operable to adjust at least one of a fluid dispensing flow rate, a brushroll speed, a suction power level, based on data from the floor type sensor.

17. The surface cleaning apparatus of claim 8, wherein the baffle comprises a baffle wall with a curved lower surface spaced above an upper end of the standpipe, the upper end of the standpipe comprising a standpipe outlet opening in fluid communication with a tank inlet at the bottom of the recovery tank.

18. The surface cleaning apparatus of claim 17, wherein the baffle is offset relative to the standpipe opening.

19. The surface cleaning apparatus of claim 8, wherein the baffle comprises a forward edge and a rear edge, wherein the forward edge is disposed farther from the standpipe than the rear edge, wherein the baffle comprises a deflector surface having a sharper forward curved portion approaching the forward edge and a gentler rearward curved portion approaching the rear edge.

20. The surface cleaning apparatus of claim 8, wherein the baffle is spaced from an inner surface of the recovery tank, such spacing forming at least one flow gap between the baffle and the recovery tank.

* * * * *